US011649612B2

(12) United States Patent
Narikawa et al.

(10) Patent No.: US 11,649,612 B2
(45) Date of Patent: May 16, 2023

(54) WORK MACHINE

(71) Applicant: HITACHI CONSTRUCTION MACHINERY CO., LTD., Tokyo (JP)

(72) Inventors: Ryu Narikawa, Tokyo (JP); Hiroshi Sakamoto, Tsuchiura (JP); Hidekazu Moriki, Tokyo (JP); Shinji Ishihara, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 322 days.

(21) Appl. No.: 16/768,951

(22) PCT Filed: Dec. 26, 2018

(86) PCT No.: PCT/JP2018/047806
§ 371 (c)(1),
(2) Date: Jun. 2, 2020

(87) PCT Pub. No.: WO2019/131743
PCT Pub. Date: Jul. 4, 2019

(65) Prior Publication Data

US 2021/0079625 A1 Mar. 18, 2021

(30) Foreign Application Priority Data

Dec. 26, 2017 (JP) ..... JP2017-249190

(51) Int. Cl.
*E02F 9/26* (2006.01)
*E02F 3/43* (2006.01)

(52) U.S. Cl.
CPC ..... *E02F 9/26* (2013.01); *E02F 3/435* (2013.01)

(58) Field of Classification Search
CPC . E02F 3/32; E02F 3/435; E02F 9/2285; E02F 9/268; E02F 9/26
See application file for complete search history.

(56) References Cited

U.S. PATENT DOCUMENTS 10,323,388 B2 * 6/2019 Kanari ..... E02F 9/264
2003/0001751 A1 * 1/2003 Ogura ..... E02F 9/2296 340/425.5

(Continued)

FOREIGN PATENT DOCUMENTS

JP 2016-186210 A 10/2016
JP 2016-204840 A 12/2016

(Continued)

OTHER PUBLICATIONS

International Preliminary Report on Patentability dated Jul. 9, 2020, received in corresponding International Application No. PCT/JP2018/047806.

(Continued)

*Primary Examiner* — Abiy Teka
(74) *Attorney, Agent, or Firm* — Mattingly & Malur, PC

(57) ABSTRACT

A hydraulic excavator including a controller that calculates the positional relationship between a bucket and a target surface and a display device that displays the positional relationship between the bucket and the target surface includes an actuator state sensor that detects the pressure of a hydraulic cylinder. The controller calculates the velocity of the bucket based on the position of a work implement and the operation amount of an operation device and changes the contents of informing by the display device according to the velocity of the bucket, the distance between the bucket and the target surface, and the pressure of the hydraulic cylinder. The display device displays the contents of informing changed by the controller.

10 Claims, 23 Drawing Sheets

(56) References Cited

U.S. PATENT DOCUMENTS

| | | | | |
|---|---|---|---|---|
| 2007/0010925 | A1* | 1/2007 | Yokoyama | E02F 9/261 37/413 |
| 2009/0088931 | A1* | 4/2009 | Budde | E02F 9/265 701/50 |
| 2018/0030694 | A1 | 2/2018 | Kanari et al. | |
| 2018/0202130 | A1 | 7/2018 | Morimoto | |

FOREIGN PATENT DOCUMENTS

| | | | |
|---|---|---|---|
| JP | 2017-11047 | A | 6/2017 |
| WO | 2017/047654 | A1 | 3/2017 |

OTHER PUBLICATIONS

International Search Report of PCT/JP2018/047806 dated Apr. 2, 2019.

Extended European Search Report received in corresponding European Application No. 18897151.9 dated Oct. 26, 2021.

* cited by examiner

WORK MACHINE

TECHNICAL FIELD

The present invention relates to a work machine.

BACKGROUND ART

With a work machine including a work implement (front work implement), typified by a hydraulic excavator, an operator directs operation of the work implement by an operation lever (operation device) and thereby the work implement is driven. Thereby, the work machine shapes a terrain profile that is a working target into a desired shape. Machine guidance (MG) exists as a technique that aims at assisting such work. The MG is a technique that implements operation assistance of the operator by informing the operator of the positional relationship between data of a design surface (referred to also as target surface) showing a desired shape of a working target desired to be finally realized and work equipment that excavates the working target.

As a technique obtained by adding an improvement to the conventional MG, there is a technique described in Patent Document 1. In this document, a display system of a construction machine showing the positional relationship between work equipment and a target surface is disclosed. The display system of the construction machine includes a movement direction calculating section that calculates a predicted movement direction of the work equipment based on at least one of a calculated value of a position-posture calculating section that calculates the position and posture of a work implement based on a state amount relating to the position and posture of the work implement and the operation amount of an operation device of a work device. The display system includes also a work equipment display control section. (1) When movement of the work equipment is predicted by the movement direction calculating section, the work equipment display control section changes, on a display screen of a display device, the display position of an image of the work equipment according to the predicted movement direction in such a manner that the area of a region located on the side of the predicted movement direction from the image of the work equipment becomes larger than that in the case of displaying the image of the work equipment at a reference position. (2) In the case other than (1), the work equipment display control section displays the image of the work equipment at the reference position on the display screen. The display system includes also a target surface display control section that displays, on the display screen, an image of the target surface included in the display screen when the image of the work equipment is displayed at a display position decided by the work equipment display control section. That is, the shape of the target surface existing in the predicted travelling direction of the work equipment (predicted movement direction) is displayed relatively widely compared with a shape relating to the other directions.

PRIOR ART DOCUMENT

Patent Document

Patent Document 1: JP-2016-204840-A

SUMMARY OF THE INVENTION

Problem to be Solved by the Invention

In Patent Document 1, the predicted movement direction of the work equipment, which is not used in the conventional MG, i.e. the direction of the velocity vector of the work equipment, is used. Thereby, the shape of the target surface existing in the direction of the velocity vector of the work equipment is allowed to be displayed relatively widely and the operator is allowed to easily understand the shape of the target surface existing in the direction of the velocity vector.

When data on the work machine that is not actively used as a trigger for change in the contents of the MG conventionally (direction of the velocity vector of the work equipment in the above-described example) is used as in this technique, new functions can be added to the MG and functions of the MG can be improved. There is a possibility that, due to the addition and improvement of functions of the MG, the MG in conformity with the intention of the operator becomes possible and the operator is enabled to intuitively recognize the situation of the work machine, for example.

For example, when an operator inputs arm crowding operation in the technique of Patent Document 1, a region existing in the predicted movement direction of the work equipment calculated from the operation is widely displayed on the screen. However, whether the work equipment has actually moved is not considered in this technique. Therefore, the same displaying is carried out also when the claw tip gets contact with very hard soil in the arm crowding operation and the arm operation stops with an arm cylinder being in an overload state, for example. When the operator intends arm dumping operation in order to eliminate the stop state of the arm in such a scene, there is a possibility of the occurrence of an inconvenience that the shape of the target surface existing in the arm dumping direction can not be understood in advance because displaying change of the screen is not carried out unless actually the arm crowding operation is stopped or the arm dumping operation is input. That is, there is room for improvement in the technique of this document.

An object of the present invention is to intend addition and improvement of functions of the MG in a work machine.

Means for Solving the Problem

The present application includes plural means for solving the above-described problem. To cite one example thereof, there is provided a work machine including an articulated work implement including work equipment, an actuator that drives the work implement, an operation device that makes an instruction of operation of the actuator, a controller configured to calculate a position of the work implement and calculate a distance between the work equipment and a predetermined target surface and calculate a positional relationship between the work equipment and the target surface, and an informing device that informs the positional relationship between the work equipment and the target surface, the work machine including an actuator state sensor that detects a state of the actuator, wherein the controller calculates a velocity of the work equipment based on the position of the work implement and an operation amount of the operation device, and changes contents of informing by the informing device according to the velocity of the work equipment, the distance between the work equipment and the target surface, and the state of the actuator detected by the actuator state sensor.

Advantages of the Invention

According to the present invention, the situation under which a work machine is put can be grasped more objectively by considering the state of the actuator in addition to conventional data, and functions of the MG can be added and improved.

MODES FOR CARRYING OUT THE INVENTION

Embodiments of the present invention will be described below by using the drawings. In the following, the description will be made by taking as an example a hydraulic excavator as a work machine. As the front work implement of the hydraulic excavator, what is composed of a boom, an arm, and work equipment and includes a bucket as the work equipment is exemplified. However, what includes an attachment other than the bucket may be employed. Furthermore, a work machine other than the hydraulic excavator may be employed. In addition, when plural same constituent elements exist, alphabets are often given to the tail ends of characters (numbers). However, these alphabets are omitted and these plural constituent elements are represented collectively in some cases. For example, when three pumps 300*a*, 300*b*, and 300*c* exist, they are represented as pumps 300 collectively in some cases.

First Embodiment

Figure 1:
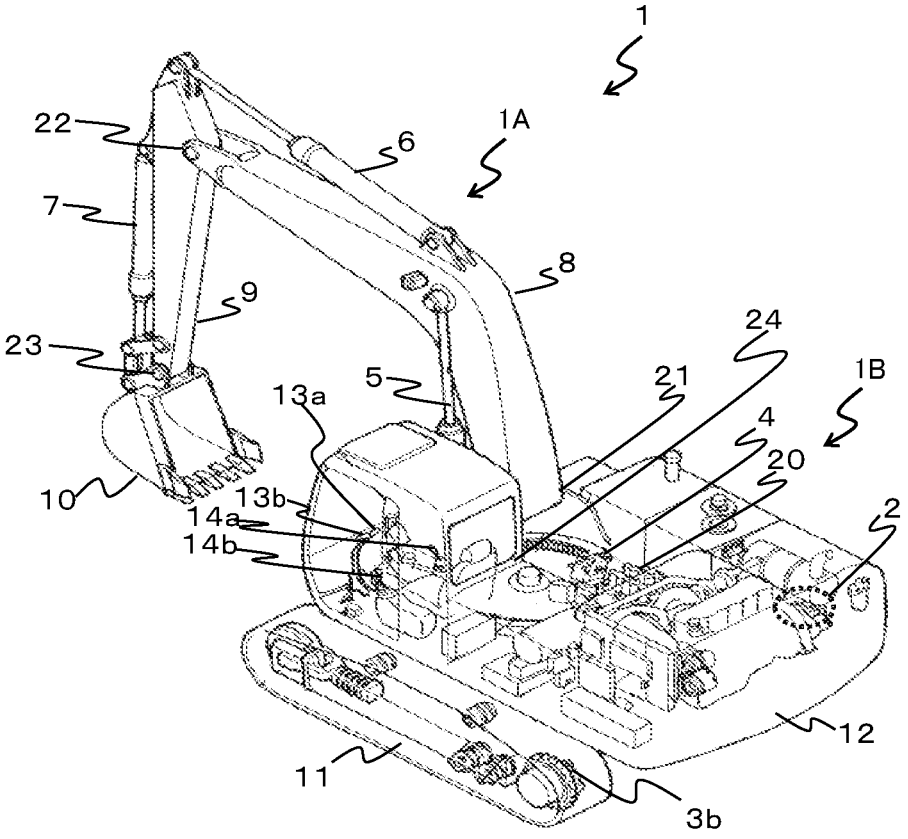
FIG. 1 is a configuration diagram of a hydraulic excavator.

FIG. 1 is a configuration diagram of a hydraulic excavator according to a first embodiment of the present invention. In FIG. 1, a hydraulic excavator 1 is composed of a front work implement 1A and a machine body 1B. The machine body 1B is composed of a lower track structure 11 and an upper swing structure 12 swingably attached on the lower track structure 11. The front work implement 1A is configured by joining plural driven members (boom 8, arm 9, and bucket 10) that each pivot in the perpendicular direction. The base end of the boom 8 of the front work implement 1A is pivotally supported by the front part of the upper swing structure 12 with the intermediary of a boom pin. The arm 9 is pivotally joined to the tip of the boom 8 with the intermediary of an arm pin. The bucket 10 is pivotally supported by the tip of the arm 9 with the intermediary of a bucket pin.

The boom 8, the arm 9, the bucket 10, the upper swing structure 12, and the lower track structure 11 configure driven members driven by a boom cylinder 5, an arm cylinder 6, a bucket cylinder 7, a swing hydraulic motor 4, and right and left travelling motors 3*a* and 3*b* that are not shown in the diagram, respectively. Operation instructions to these driven members 8, 9, 10, 12, and 11 are output according to operation, by an operator, of a travelling right lever 13*a*, a travelling left lever 13*b*, an operation right lever 14*a*, and an operation left lever 14*b* mounted in a cab on the upper swing structure 12. These travelling levers 13 and operation levers 14 are referred to also as an operation device 15 collectively. Furthermore, the operation right lever 14*a* functions as an operation lever 15*a* for the boom and an operation lever 15*c* for the bucket in FIG. 2, and the operation left lever 14*b* functions as an operation lever 15*b* for the arm and an operation lever 15*d* for swing in FIG. 2.

Figure 2:
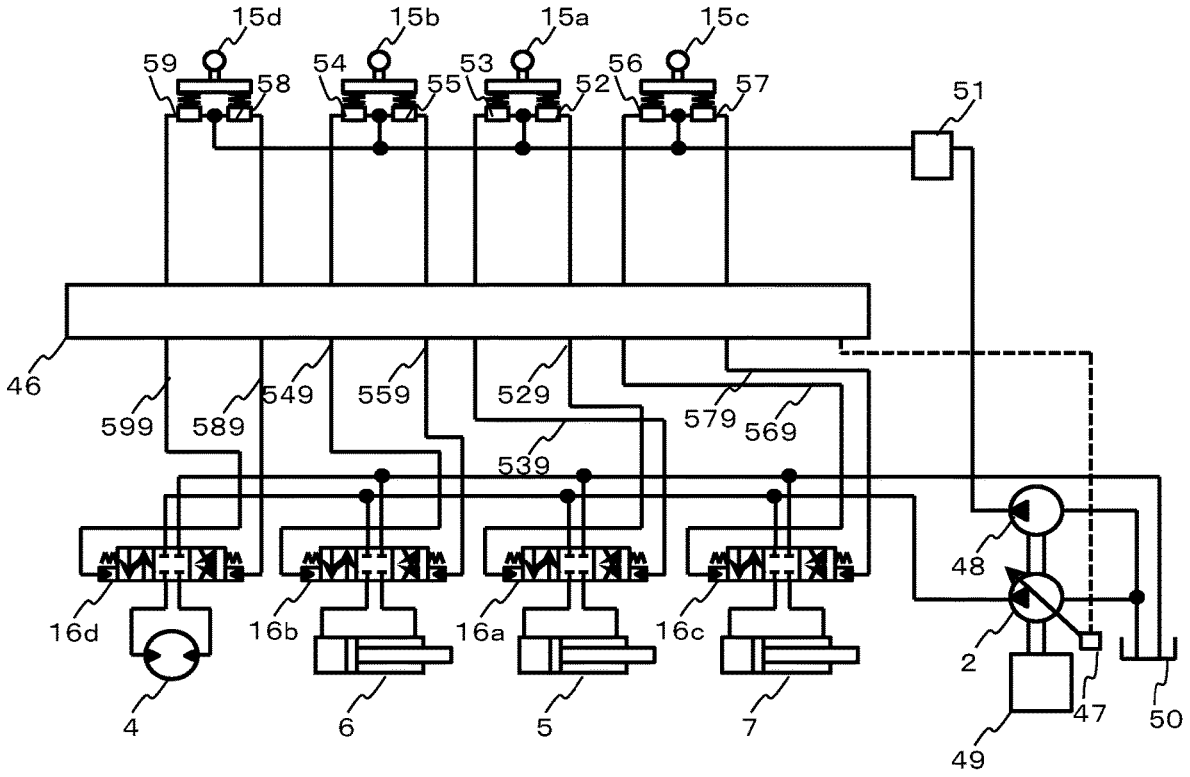
FIG. 2 is a schematic diagram of a hydraulic circuit relating to the hydraulic excavator.

The operation device 15 of the present embodiment is a device of a hydraulic pilot system. A pilot pressure (often referred to as operation pressure or operation signal) according to the operation amount (for example, lever stroke) of each lever is supplied to flow control valves 16*a* to 16*d* (see FIG. 2) according to the operation direction of the respective levers to drive these flow control valves 16*a* to 16*d*. In FIG. 2, diagrammatic representation of the operation levers for travelling and flow control valves corresponding thereto is omitted.

Hydraulic fluid delivered by a hydraulic pump 2 driven by a prime mover (engine) 49 is supplied to hydraulic actuators such as the swing hydraulic motor 4, the boom cylinder 5, the arm cylinder 6, and the bucket cylinder 7 through the flow control valves 16*a*, 16*b*, 16*c*, and 16*d* (see FIG. 2). The boom cylinder 5, the arm cylinder 6, and the bucket cylinder 7 expand and contract by the supplied hydraulic fluid. Thereby, the boom 8, the arm 9, and the bucket 10 each pivot and the position and posture of the bucket 10 located at the tip of the front work implement 1A change. Furthermore, the swing hydraulic motor 4 rotates by the supplied hydraulic fluid and thereby the upper swing structure 12 swings around a swing axis relative to the lower track structure 11. Moreover, the travelling right hydraulic motor 3*a* and the travelling left hydraulic motor 3*b* rotate by the supplied hydraulic fluid and thereby the lower track structure 11 travels.

Meanwhile, in order to enable measurement of the pivot angle of the boom 8, the arm 9, and the bucket 10, a boom angle sensor 21 is attached to the boom pin that joins the upper swing structure 12 and the boom 8, an arm angle sensor 22 is attached to the arm pin that joins the boom 8 and the arm 9, and a bucket angle sensor 23 is attached to the bucket pin that joins the arm 9 and the bucket 10. Furthermore, a machine body inclination angle sensor 24 that detects the inclination angles of the upper swing structure 12 (machine body 1B) in the front-rear direction and the right-left direction with respect to a reference surface (for example, gravitational direction) is attached to the upper swing structure 12. The angle sensors 21, 22, and 23 can be each replaced by an angle sensor that outputs the angle with respect to the reference surface (for example, gravitational direction).

Figure 3:
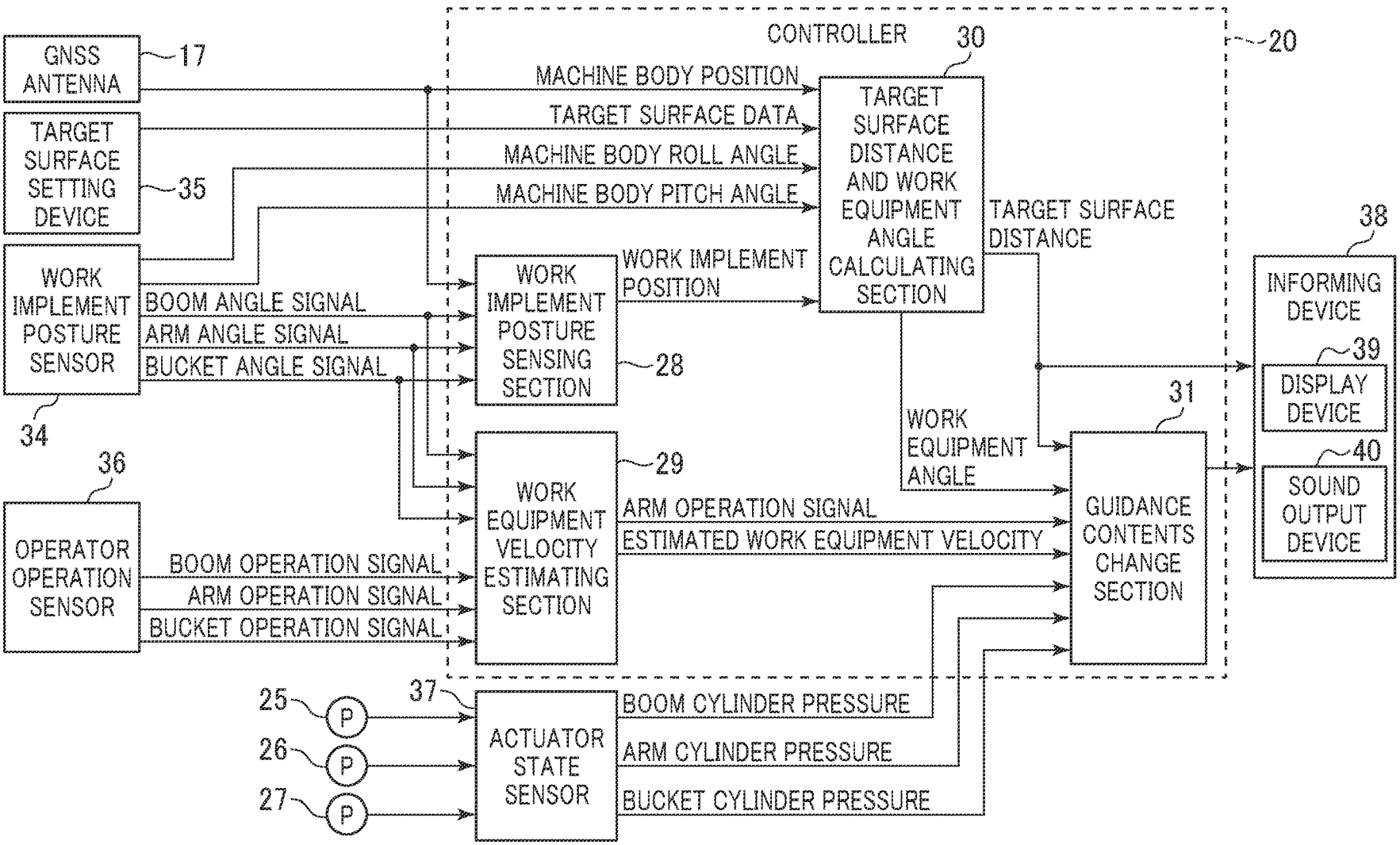
FIG. 3 is a functional block diagram of a controller.

Furthermore, to the boom cylinder 5, the arm cylinder 6, and the bucket cylinder 7, a boom cylinder pressure sensor 25, an arm cylinder pressure sensor 26, and a bucket cylinder pressure sensor 27 that can measure the pressure generated in the respective cylinders and are shown in FIG. 3 are attached. The respective pressure sensors 25, 26, and 27 are composed of at least two pressure sensors so that the pressure of the bottom side and the rod side of the hydraulic cylinders 5, 6, and 7 for which they are set can be detected. However, the pressure sensors 25, 26, and 27 are each expressed by one symbol as simplification in the present specification.

FIG. 2 is a hydraulic circuit diagram of the hydraulic excavator 1. The hydraulic pump 2 and a pilot pump 48 are driven by the prime mover 49. Hydraulic fluid supplied from the hydraulic pump 2 drives hydraulic actuators such as the boom cylinder 5 and the swing motor 4. Hydraulic fluid supplied from the pilot pump 48 drives the flow control valves 16.

The hydraulic fluid delivered from the hydraulic pump 2 goes through the flow control valves 16*a* to 16*d* and is supplied to the hydraulic actuators such as the boom cylinder 5, the arm cylinder 6, and the bucket cylinder 7. The hydraulic fluid supplied to the hydraulic actuators goes through the flow control valves 16*a* to 16*d* again and is discharged to a tank 50.

The pilot pump 48 is connected to a lock valve 51. Lock of the lock valve 51 is released through operation of a gate lock lever (not shown) mounted in the cab by the operator and thereby the hydraulic fluid from the pilot pump 48 comes to flow to the downstream of the lock valve 51. The downstream of the lock valve 51 is connected to a pilot pressure control valve 52 for boom raising, a pilot pressure control valve 53 for boom lowering, a pilot pressure control valve 54 for arm crowding, a pilot pressure control valve 55 for arm dumping, a pilot pressure control valve 56 for bucket crowding, a pilot pressure control valve 57 for bucket dumping, a pilot pressure control valve 58 for right swing, a pilot pressure control valve 59 for left swing, and so forth.

The pilot pressure control valve 52 for boom raising and the pilot pressure control valve 53 for boom lowering can be operated by the operation lever 15*a* for the boom. The pilot pressure control valve 54 for arm crowding and the pilot pressure control valve 55 for arm dumping can be operated by the operation lever 15*b* for the arm. The pilot pressure control valve 56 for bucket crowding and the pilot pressure control valve 57 for bucket dumping can be operated by the operation lever 15*c* for the bucket. The pilot pressure control valve 58 for right swing and the pilot pressure control valve 59 for left swing can be operated by the operation lever 15*d* for swing.

At the downstream of the pilot pressure control valve 52 for boom raising, the pilot pressure control valve 53 for boom lowering, the pilot pressure control valve 54 for arm crowding, the pilot pressure control valve 55 for arm dumping, the pilot pressure control valve 56 for bucket crowding, the pilot pressure control valve 57 for bucket dumping, the pilot pressure control valve 58 for right swing, and the pilot pressure control valve 59 for left swing, pressure sensors (not shown) that detect the pilot pressure are each disposed as an operator operation sensor 36. The operation amount of the respective operation levers 15*a*, 15*b*, 15*c*, and 15*d* by the operator can be detected by this pressure sensor. As the specific operator operation sensor 36 of the present embodiment, the following pilot pressure sensors are disposed: a pilot pressure sensor for boom raising disposed on a pilot line 529 for boom raising; a pilot pressure sensor for boom lowering disposed on a pilot line 539 for boom lowering; a pilot pressure sensor for arm crowding disposed on a pilot line 549 for arm crowding; a pilot pressure sensor for arm dumping disposed on a pilot line 559 for arm dumping; a pilot pressure sensor for bucket crowding disposed on a pilot line 569 for bucket crowding, a pilot pressure sensor for bucket dumping disposed on a pilot line 579 for bucket dumping, a pilot pressure sensor for right swing disposed on a pilot line 589 for right swing; and a pilot pressure sensor for left swing disposed on a pilot line 599 for left swing.

A shuttle block 46 is set on the downstream side of the above-described eight pilot pressure sensors and the configuration is made in such a manner that a control signal (pilot pressure) can be output from the shuttle block 46 to a regulator 47 attached to the hydraulic pump 2. The shuttle block 46 controls the pressure of the control signal used for control of the hydraulic pump 2. The regulator 47 changes the delivery flow rate of the hydraulic pump 2 by adjusting the tilting angle of the hydraulic pump 2 according to the operation amount of the operation device 15. The flow control valve 16*a* for the boom is connected to the downstream of the pilot line 529 for boom raising and the pilot line 539 for boom lowering with the intermediary of the shuttle block 46. The flow control valve 16*b* for the arm is connected to the downstream of the pilot line 549 for arm crowding and the pilot line 559 for arm dumping with the intermediary of the shuttle block 46. The flow control valve 16*c* for the bucket is connected to the downstream of the pilot line 569 for bucket crowding and the pilot line 579 for bucket dumping with the intermediary of the shuttle block 46. The flow control valve 16*d* for swing is connected to the downstream of the pilot line 589 for right swing and the pilot line 599 for left swing with the intermediary of the shuttle block 46. The flow control valves 16*a* to 16*d* are configured to operate according to the pilot pressure output from the operation device 15 and be capable of controlling the flow rate of the hydraulic operating fluid supplied to the respective hydraulic actuators 4, 5, 6, and 7 according to the operation amount of the operation device 15.

A controller 20 responsible for the MG is mounted in the hydraulic excavator 1. The controller 20 has an input interface, a central processing unit (CPU) that is a processor, a read only memory (ROM) and a random access memory (RAM) that are storing devices, and an output interface (none is shown). The input interface converts signals from the respective devices connected to the controller 20 in such a manner that the CPU can carry out calculation. The ROM is a recording medium in which a control program for executing the MG including processing relating to flowcharts to be described later and various kinds of data and so forth necessary for execution of these flowcharts are stored. The CPU executes predetermined calculation processing for signals taken in from the input interface, the ROM, and the RAM 94 in accordance with the control program stored in the ROM. The output interface creates a signal for output according to the calculation result in the CPU and outputs the signal to an informing device and thereby can actuate the informing device. Although the controller 20 of the present embodiment includes semiconductor memories of the ROM and RAM as the storing device, they can be replaced particularly as long as the replacement is a storing device and the controller 20 may include a magnetic storing device such as a hard disk drive, for example.

In FIG. 3, a functional block diagram of the controller (controller) 20 mounted in the hydraulic excavator 1 is shown. As shown in this diagram, the controller 20 of the present embodiment functions as a work implement posture sensing section 28, a work equipment velocity estimating section 29, a target surface distance and work equipment angle calculating section 30, and a guidance contents change section 31. Furthermore, to the controller, a work implement posture sensor 34, a target surface setting device 35, the operator operation sensor 36, an actuator state sensor 37, an informing device 38, and a GNSS (Global Navigation Satellite System) antenna 17 are connected.

The work implement posture sensor 34 is composed of the boom angle sensor 21, the arm angle sensor 22, the bucket angle sensor 23, and the machine body inclination angle sensor 24.

The target surface setting device 35 is an interface to which data relating to a predetermined target surface 62 that should be formed by excavating of the hydraulic excavator 1 (including position data and inclination angle data of each target surface) can be input, and can also store the input data relating to the target surface 62. The target surface 62 is what is obtained by extracting and modifying a design surface in a form suitable for working. The target surface setting device 35 can connect to an external terminal (not shown) that stores three-dimensional data of the target surface defined on a global coordinate system (absolute coordinate system). The position data of the target surface 62 is created based on the position data of the design surface that is the final target shape that should be formed by excavating of the hydraulic excavator 1. Normally, the target surface 62 is set on the design surface or above that in the case of excavating, and is set on the design surface or below that in the case of embankment. The input of the data relating to the target surface 62 through the target surface setting device 35 may be manually carried out by an operator. Furthermore, the target surface 62 does not need to be defined on the global coordinate system and may be defined on a local coordinate system of the hydraulic excavator 1 set on the upper swing structure 12, for example. In this case, the need to mount the GNSS antenna 17 is eliminated in terms of calculation of the position of the upper swing structure 12 (position of the machine body 1B) in the global coordinate system.

The GNSS antenna 17 is attached onto the upper swing structure 12 and receives a navigation signal from plural (normally four or more) navigation satellites to output the signal to the controller 20. Data on the navigation signal received by the GNSS antenna 17 is used when position data in the global coordinates regarding the upper swing structure 12 (machine body 1B) is computed. The number of GNSS antennas 17 may be one. However, the posture of the upper swing structure 12 can be calculated when two GNSS antennas 17 are mounted.

The operator operation sensor 36 is composed of the already-described eight pressure sensors that acquire the pilot pressure generated due to operation of the operation device 15 by the operator (i.e. pilot pressure sensor for boom raising, pilot pressure sensor for boom lowering, pilot pressure sensor for arm crowding, pilot pressure sensor for arm dumping, pilot pressure sensor for bucket crowding, pilot pressure sensor for bucket dumping, pilot pressure sensor for right swing, pilot pressure sensor for left swing). To the work equipment velocity estimating section 29 in the controller 20, detection values of the pilot pressure sensor for boom raising and the pilot pressure sensor for boom lowering are output as a boom operation signal and detection values of the pilot pressure sensor for arm crowding and the pilot pressure sensor for arm dumping are output as an arm operation signal and detection values of the pilot pressure sensor for bucket crowding and the pilot pressure sensor for bucket dumping are output as a bucket operation signal.

The actuator state sensor 37 is a device for detecting the physical amount showing the state of the hydraulic actuators 5, 6, and 7. In the present embodiment, the actuator state sensor 37 is composed of the boom cylinder pressure sensor 25, the arm cylinder pressure sensor 26, and the bucket cylinder pressure sensor 27 and the controller 20 is capable of calculating the load acting on the respective hydraulic actuators 5, 6, and 7 based on the output of the respective pressure sensors 25, 26, and 27.

The informing device 38 is a device for informing the operator of at least the positional relationship between the bucket 10 and the target surface 62 and, in the present embodiment, is composed of at least a display device 39 such as a monitor and a sound output device 40 such as a speaker.

The work implement posture sensing section 28 is a section that calculates posture data of the front work implement 1A (posture data of the boom 8, the arm 9, and the bucket 10) and position data of the tip (claw tip) of the bucket 10 in the local coordinate system set on the upper swing structure 12. The work implement posture sensing section 28 calculates the posture data of the front work implement 1A and the coordinates of the tip (claw tip) of the bucket 10 in the local coordinate system based on a boom angle signal, an arm angle signal, and a bucket angle signal input from the work implement posture sensor 34 and dimension data of the boom 8, the arm 9, and the bucket 10 recorded in the storing device in the controller 20, and outputs the calculation result thereof to the target surface distance and work equipment angle calculating section 30.

The target surface distance and work equipment calculating section 30 is a section that calculates the target surface distance that is the distance between the target surface 62 and the bucket tip and the work equipment angle that is the angle formed by the target surface 62 and the back surface of the bucket 10. The target surface distance and work equipment angle calculating section 30 calculates the position data in the global coordinates regarding the upper swing structure 12 based on the navigation signal input from the GNSS antenna 17 and calculates posture data in the global coordinates regarding the upper swing structure 12 based on roll angle data and pitch angle data of the machine body 1B input from the work implement posture sensor 34. Then, the target surface distance and work equipment angle calculating section 30 uses the position data and the posture data in the global coordinates regarding the upper swing structure 12 to convert the posture data of the front work implement 1A and the position data of the bucket tip in the local coordinate system input from the work implement posture sensing section 28 to values in the global coordinate system. The target surface distance and work equipment angle calculating section 30 calculates the target surface distance based on the position data of the bucket tip calculated in this manner and the position data of the target surface 62 input from the target surface setting device 35. Furthermore, the target surface distance and work equipment angle calculating section 30 calculates the work equipment angle based on the position data and the posture data of the bucket tip and the position data of the target surface 62.

Figure 4:
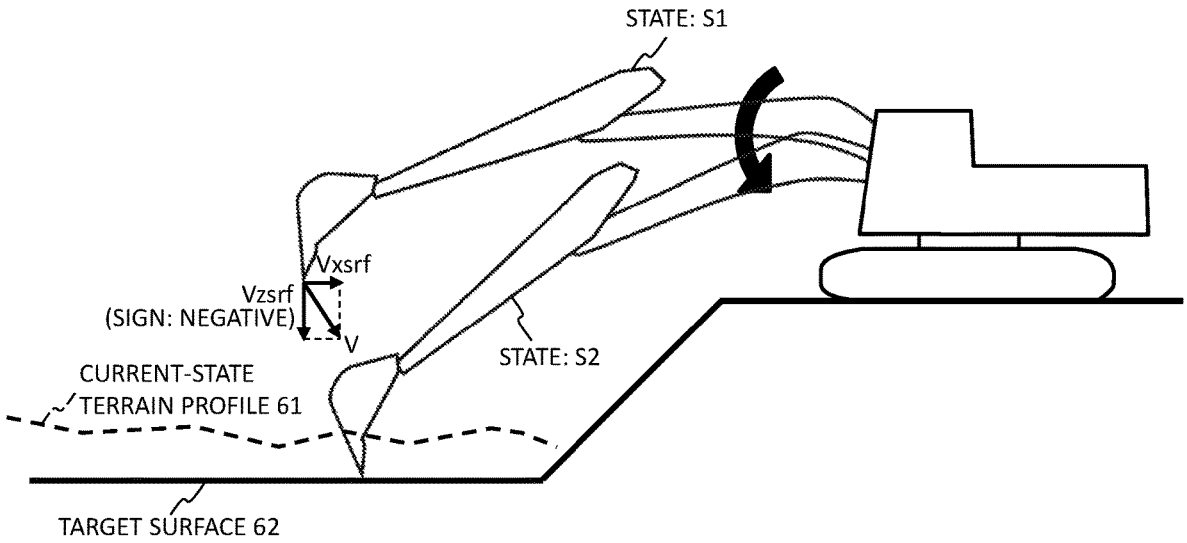
FIG. 4 is a diagram showing the hydraulic excavator that carries out alignment work by boom operation.
Figure 5:
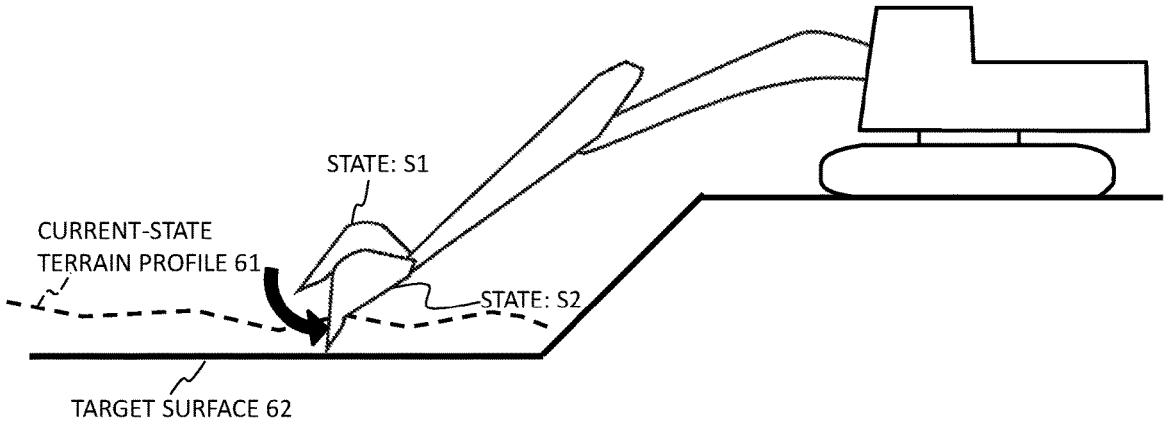
FIG. 5 is a diagram showing the hydraulic excavator that carries out alignment work by bucket operation.

Examples of alignment work of the bucket 10 based on operation of the operation device 15 by an operator are shown in FIG. 4 and FIG. 5. Here, the alignment work (alignment operation) of the bucket 10 is work (operation) of moving the bucket 10 to a start position (referred to as "work start position") of work carried out through causing the arm 9 to carry out crowding operation or dumping operation (typically excavating). Various kinds of work by arm operation are carried out after the alignment work is completed. In FIG. 4, alignment work of lowering the boom 8 to move the bucket 10 to the work start position on the target surface 62 is shown. In FIG. 5, alignment work of causing the bucket 10 to pivot to move the bucket 10 to the work start position on the target surface 62 is shown.

In FIG. 4, a situation is shown in which an operator aligns the tip of the bucket 10 onto the target surface 62 by operating the operation device 15 and causing the boom 8 to carry out lowering operation. Specifically, FIG. 4 shows a series of work by which a transition is made from a state S1 in which the bucket 10 exists above the target surface 62 and is separate from the target surface 62 to a state S2 in which the bucket 10 is still at the work start position on the target surface 62.

In the state S1, a velocity vector generated at the tip of the bucket 10 due to the lowering operation of the boom 8 by the operator is defined as V, and the component parallel to the target surface 62 in V is defined as Vxsrf and the perpendicular component is defined as Vzsrf. Furthermore, regarding the sign of Vzsrf, the vertical upward direction with respect to the target surface 62 is deemed as positive and the vertical downward direction with respect to the target surface 62 is deemed as negative.

The calculation of the velocity vector V is carried out by the work equipment velocity estimating section 29 based on detection values of the work implement posture sensor 34 and the operator operation sensor 36. Specifically, the velocities of the respective hydraulic cylinders 5, 6, and 7 are calculated from the pilot pressures (operation signals) to the respective hydraulic cylinders 5, 6, and 7 generated due to operation of the operation device 15 by the operator and the respective hydraulic cylinder velocities are converted to the angular velocity of each of the boom 8, the arm 9, and the bucket 10 by using the posture data of the work implement 1A. Moreover, the angular velocity is converted to the velocity vector of the tip of the bucket 10 and thereby the velocity vector V is figured out. As already described, the posture data of the work implement 1A can be calculated from the angle signals of the boom 8, the arm 9, and the bucket 10 input from the work implement posture sensor 34.

In FIG. 4, a current-state terrain profile 61 that is an excavation target exists only near the target surface 62. In this case, when the front work implement 1A makes the transition from the state S1 to the state S2, it is hard for the excavation load on the front work implement 1A due to the current-state terrain profile 61 to increase even when the bucket 10 comes close to the vicinity of the target surface 62. For this reason, the possibility of entry of the bucket 10 into the lower side of the target surface 62 becomes high when the component Vzsrf perpendicular to the target surface 62 in the velocity vector V of the bucket tip generated due to operator operation is large in the negative direction. In the present embodiment, whether or not an excavation load is acting on the front work implement 1A is determined by the guidance contents change section 31 based on whether or not the pressure that is the pressure generated in the hydraulic cylinder 5, 6, or 7 and is detected by the pressure sensor 25, 26, or 27 is equal to or higher than a predetermined threshold. Then, if the detected pressure of the pressure sensor 25, 26, or 27 is equal to or higher than this predetermined threshold, it is determined that an excavation load is acting on the relevant hydraulic cylinder.

Also in FIG. 5, similarly to the above description, the velocity vector V generated at the tip of the bucket 10 can be computed and the possibility of entry of the bucket 10 into the lower side of the target surface 62 becomes higher when the component Vzsrf perpendicular to the target surface 62 in the velocity vector is larger in the negative direction.

The guidance contents change section 31 determines whether or not the possibility of entry of the bucket 10 into the lower side of the target surface 62 due to operator operation is high based on the perpendicular component Vzsrf of the velocity vector V, the target surface distance, the pressure of the hydraulic actuators (hydraulic cylinders) 5, 6, and 7, and the angle of the bucket 10 with respect to the target surface 62. When determining that the possibility of entry is high in this determination, the guidance contents change section 31 outputs a warning informing flag to the informing device 38.

Figure 6:
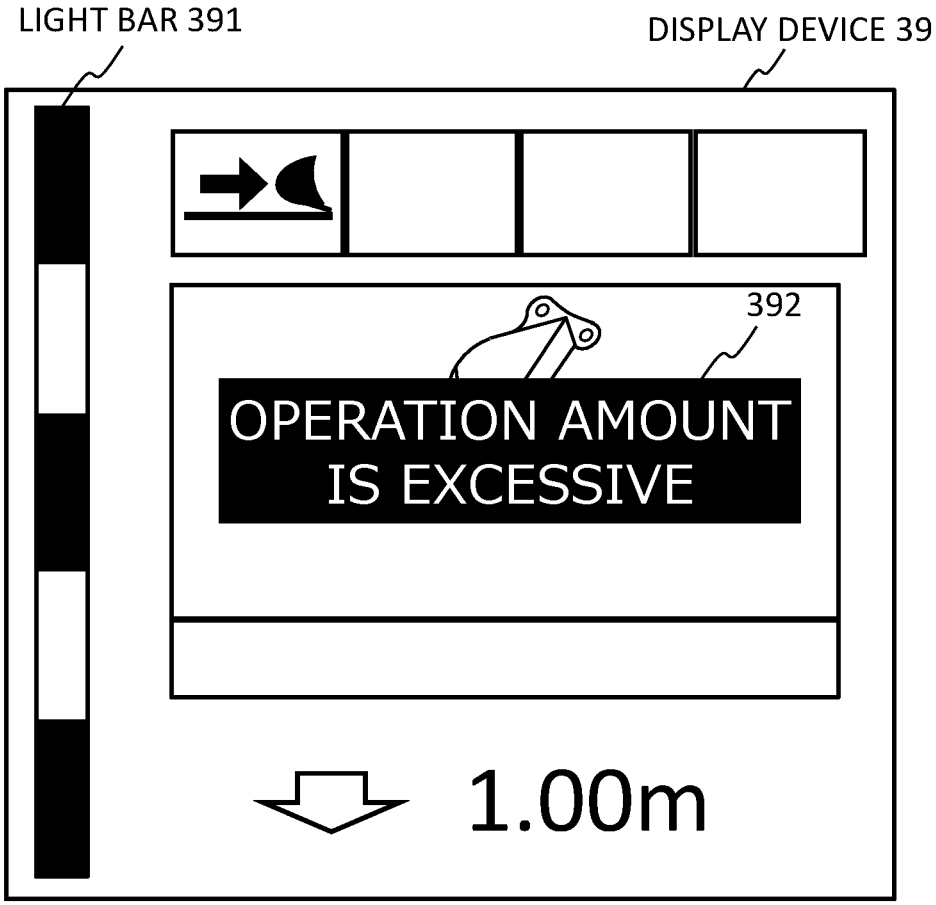
FIG. 6 is a diagram showing one example of a display screen of a display device.
Figure 7:
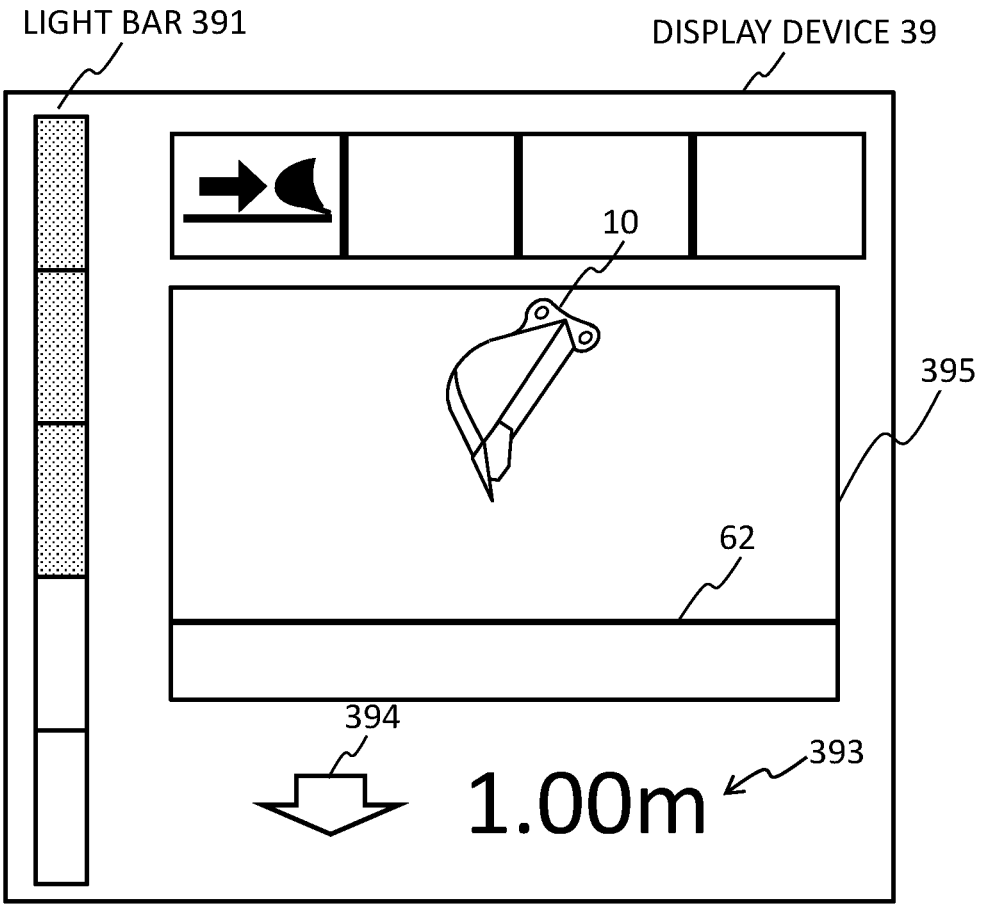
FIG. 7 is a diagram showing one example of the display screen of the display device.

When the warning informing flag is input from the guidance contents change section 31, the informing device 38 carries out informing different from the normal MG (see FIG. 7) in which the distance between the bucket claw tip and the target surface is shown by a light bar 391 while the positional relationship between the bucket 10 and the target surface 62 is shown by an image. Specifically, as shown in FIG. 6, the display device 39 informs the operator of that the operation amount to the operation device 15 is excessive by displaying a popup message 392 showing that the operation amount is excessive and flickering the light bar 391 showing the distance between the target surface 62 and the bucket claw tip. Furthermore, from the sound output device 40, also as sound, sound different from the normal MG such as sound different in the frequency, is output. Thereby, the informing device 38 informs the operator of that the operation amount is excessive. The informing in this manner allows the operator to recognize that the operation amount of oneself is excessive before the bucket 10 reaches the target surface 62. Thus, the entry of the bucket 10 into the target surface 62 can be prevented. For comparison, one example of the display screen of the display device 39 when the warning informing flag is not output, i.e. at the time of the normal MG, is shown in FIG. 7. In the screen of the display device 39 in FIG. 7, a positional relationship display part 395 in which an image of the bucket 10 and the target surface 62 is displayed, a target surface distance display part 393 that shows the distance between the bucket claw tip and the target surface 62 by a numerical value, and a target surface direction display part 394 that shows, by an arrow, the direction of the target surface 62 when the claw tip of the bucket 10 is deemed as the basis are set.

The light bar 391 turns on according to the distance between the target surface 62 and the bucket 10. The light bar 391 in FIG. 7 is composed five segments that are disposed serially in the vertical direction and can turn on, and dots are given to the upper-side three segments that are on in the diagram. In the present embodiment, only the central segment turns on when the claw tip of the bucket 10 exists at a distance of ±0.05 m from the target surface 62. Two segments, the central segment and the segment on the upper-side thereof, turn on when the claw tip exists at a distance of 0.05 to 0.10 m from the target surface 62. Three segments, the central segment and the two segments on the upper-side thereof, turn on when the claw tip exists at a distance beyond 0.10 m from the target surface 62. Similarly, two segments at the center and on the lower-side thereof turn on when the distance is −0.05 to −0.10 m, and three segments, the central segment and the two segments on the lower-side thereof, turn on when the distance is beyond −0.10 m. In the example of FIG. 7, the upper-side three segments are on because the distance to the target surface 62 is +1.00 m.

Figure 8:
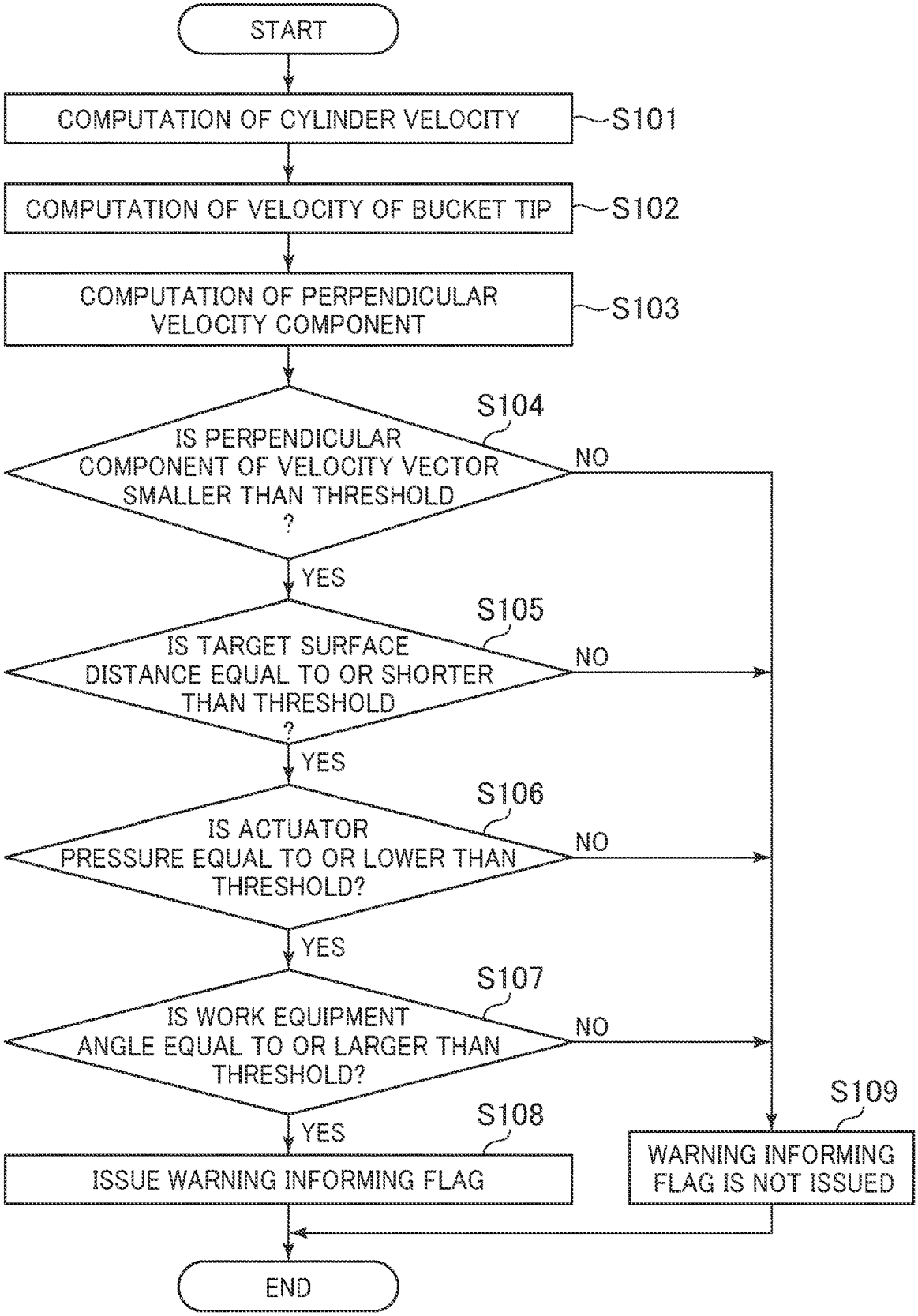
FIG. 8 is a control flow by the controller according to a first embodiment.

FIG. 8 shows a control flow by the controller 20 of the present embodiment. The controller 20 repeatedly carries out the flow of FIG. 8 at a predetermined control cycle. When the processing is started, first, in a step S101, the work equipment velocity estimating section 29 computes the velocity of the respective hydraulic cylinders 5, 6, and 7 from the boom operation signal, the arm operation signal, and the bucket operation signal input from the operator operation sensor 36.

Next, in a step S102, the work equipment velocity estimating section 29 converts the cylinder velocity of the step S101 to the angular velocity based on dimension data of the boom 8, the arm 9, and the bucket 10 (driven members) and posture data thereof (boom angle signal, arm angle signal, and bucket angle signal), and converts it to the velocity vector V of the tip of the bucket 10.

Next, in a step S103, the work equipment velocity estimating section 29 computes the horizontal component Vxsrf and the perpendicular component Vzsrf of the velocity vector V with respect to the target surface 62 from the velocity vector V of the tip of the bucket 10.

In a step S104, the guidance contents change section 31 determines whether or not the perpendicular component Vzsrf of the velocity vector V with respect to the target surface 62 is smaller than a predetermined threshold. When the perpendicular component Vzsrf is in the direction toward the lower side of the target surface 62, that is, when the bucket 10 exists on the upper side relative to the target surface 62, the direction in which the bucket 10 moves toward the target surface 62 (downward direction) is negative. Here, the threshold of the step S104 is set to zero. When the threshold is set to zero, if the perpendicular component Vzsrf is smaller than the threshold, the guidance contents change section 31 determines that the velocity of the bucket 10 is a velocity in such a direction as to come closer to the target surface 62 from the upper side of the target surface 62, and the processing proceeds to a step S105.

In the step S105, the distance between the target surface 62 and the tip of the bucket 10 (target surface distance) is input from the target surface distance and work equipment angle calculating section 30 to the guidance contents change section 31 and the guidance contents change section 31 determines whether or not the target surface distance is equal to or shorter than a predetermined threshold. If the target surface distance is equal to or shorter than the threshold, the guidance contents change section 31 determines that the bucket tip has come close to the target surface 62, and the processing proceeds to a step S106. The threshold in the step S105 is a value for determining whether or not the bucket claw tip has come close to the target surface 62. For example, the maximum value of the target surface distance that involves a possibility of entry of the tip of the bucket 10 into the lower side of the target surface 62 due to operation of the operation device 15 can be selected as the threshold.

In the step S106, the guidance contents change section 31 determines whether or not the pressure relating to the actuator of the operation target by the operation device 15 in the pressures of the actuators 5, 6, and 7 input from the actuator state sensor 37 is equal to or lower than a predetermined threshold. In the present embodiment, the threshold is set to a value comparable to a pressure when the front work implement 1A is not in contact with the working target (current-state terrain profile 61) and operates in the air (that is, when a load does not act on the respective hydraulic cylinders 5, 6, and 7). That is, the pressure exceeds the threshold when the front work implement 1A gets contact with the working target having a certain level of hardness. If it is determined that the actuator pressure is equal to or lower than the threshold, the guidance contents change section 31 determines that the work implement 1A is not in contact with the current-state terrain profile 61 in operation of the operation device 15, and the processing proceeds to a step S107.

In the step S107, the angle formed by the bottom surface of the bucket 10 and the target surface 62 (work equipment angle) is input from the target surface distance and work equipment angle calculating section 30 to the guidance contents change section 31 and the guidance contents change section 31 determines whether or not the work equipment angle is equal to or larger than a predetermined threshold. As already described, the work equipment angle can be computed from the posture of the front work implement 1A and the inclination (roll angle and pitch angle) of the machine body 1B acquired from the work implement posture sensor 34, the data on the target surface acquired from the target surface setting device 35, and the dimension data of the bucket 10 recorded in the controller 20. If the work equipment angle is smaller than the threshold, it is conceivable that the operator is intending work of pressing the bottom surface of the bucket 10 against the current-state terrain profile 61 (bumping work). Conversely, if the work equipment angle is equal to or larger than the threshold, it is deemed that the operator is intending excavating, and the processing proceeds to a step S108. As above, the threshold of the step S107 is a value for determining whether the work intended by the operator is bumping or excavation, and it is preferable to set the threshold in a range of zero to 45 degrees. As the threshold is brought closer to zero, the possibility that the intended work is determined as excavating and the processing proceeds to the step S108 becomes higher.

In the step S108, it is determined that the possibility of entry of the bucket 10 into the lower side of the target surface 62 is high, and the warning informing flag is issued. Then, the controller 20 ends the processing and waits until the next control cycle.

On the other hand, the processing proceeds to a step S109 if the condition is not satisfied in any of the step S104, the step S105, the step S106, and the step S107. In the step S109, the controller 20 ends the processing without issuing the warning informing flag and waits until the next control cycle.

Operation and Advantages

If boom lowering operation through the operation device 15*a* has been carried out as shown in FIG. 4 in the hydraulic excavator 1 configured in the above-described manner, when the target surface distance is equal to or shorter than the threshold (step S105 in FIG. 8) and the pressure of the boom cylinder 5 is equal to or lower than the threshold (step S106), the controller 20 deems that the bucket 10 has not yet gotten contact with the current-state terrain profile 61, and carries out determination of the contents of work based on the work equipment angle (step S107). Then, if the work equipment angle is equal to or larger than the threshold, the controller 20 determines that boom lowering operation is being carried out in alignment work (that is, excavating), and displays the message 392 indicating that the boom lowering operation amount is excessive on the display device (step S108). Due to this, the operator can recognize that the lever operation by oneself is excessive and is prompted to reduce the operation amount. Therefore, the entry of the bucket 10 into the lower side of the target surface 62 can be prevented. On the other hand, if the work equipment angle is smaller than the threshold, the controller 20 deems that the angle formed by the back surface of the bucket 10 and the target surface 62 is substantially parallel, and determines that boom lowering operation is being carried out in bumping work, and does not display the message 392 indicating that the boom lowering operation amount is excessive (step S109). That is, in bumping work, the message 392 is not displayed even when the bucket 10 comes close to the target surface 62 in boom lowering operation. Therefore, the operator can concentrate on the bumping work without feeling annoyance at the message.

Furthermore, if the bucket claw tip has come close to the target surface by bucket crowding operation through the operation device 15*b* as shown in FIG. 5, when the target surface distance is equal to or shorter than the threshold (step S105 in FIG. 8) and the pressure of the boom cylinder 5 is equal to or lower than the threshold (step S106), the controller 20 deems that the bucket 10 has not yet gotten contact with the current-state terrain profile 61, and carries out determination of the contents of work based on the work equipment angle (step S107). Normally, when bucket crowding operation is being input, the angle formed by the back surface of the bucket 10 and the target surface 62 (work equipment angle) becomes equal to or larger than the threshold. Therefore, the controller 20 determines that bucket crowding operation is being carried out in alignment work (that is, excavating), and displays the message 392 indicating that the bucket crowding operation amount is excessive on the display device 39 (step S108). This allows the operator to recognize that the lever operation by oneself is excessive. Thus, the operator can prevent the entry of the bucket 10 into the lower side of the target surface 62 by reducing the operation amount.

As described above, when the contents of notification to the operator through the display device 39 (informing device 38) are changed based on the state of the actuator 5 or 7, provision of the unnecessary warning message 392 to the operator in bumping work can be avoided. Therefore, the operator can carry out the bumping work without feeling annoyance at the message 392.

Furthermore, the contents of informing by the informing device 38 are changed according to the perpendicular component Vzsrf of the velocity vector V with respect to the target surface 62, the actuator pressure, the target surface distance, and the work equipment angle. Due to this, the informing device 38 does not issue an unnecessary warning and makes a warning when the possibility of entry of the bucket into the lower side of the target surface 62 is high. This can prevent the entry of the bucket into the target surface 62 more surely.

Figure 9:
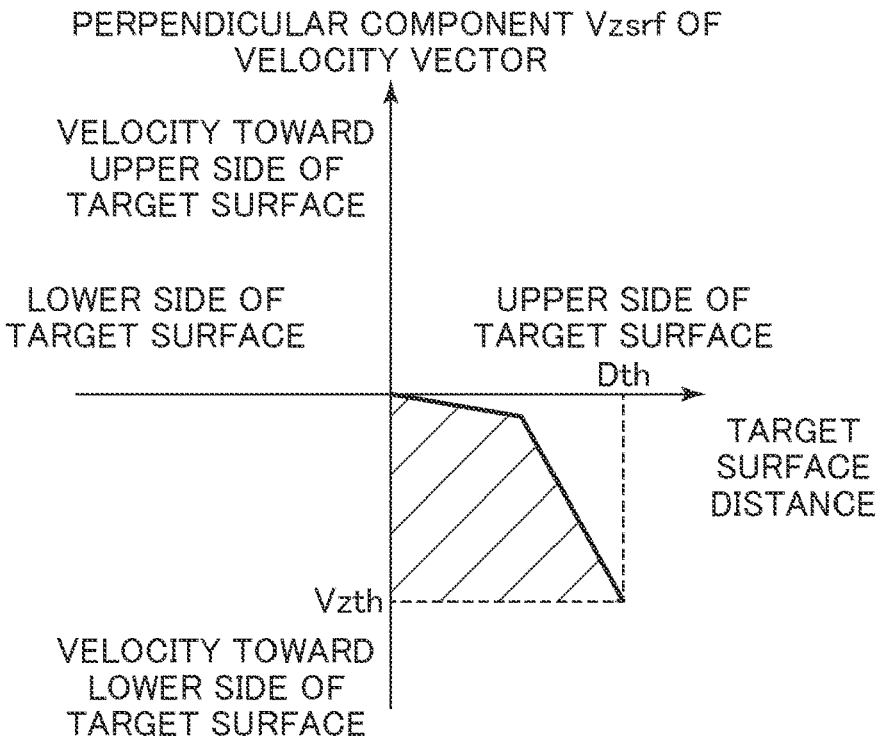
FIG. 9 is a diagram showing one example of a graph that defines a threshold.

The determination processing of the perpendicular component Vzsrf of the step S104 and the determination processing of the target surface distance of the step S105 may be integrated into one kind of processing and be executed as follows. What is shown in FIG. 9 is a graph in which the perpendicular component Vzsrf of the velocity vector V with respect to the target surface 62 is plotted on the ordinate axis and the target surface distance is plotted on the abscissa axis. Here, the processing may be caused to proceed to the step S106 when the perpendicular component Vzsrf and the target surface distance enter a hatching part shown in the fourth quadrant of the graph, and the processing may be caused to proceed to the step S109 if this is not the case. Even when the perpendicular component Vzsrf of the velocity vector V is the same, the possibility of entry into the target surface 62 varies depending on the target surface distance. For this reason, the informing device 38 is enabled to issue a warning more appropriately by setting a hatching region that associates the perpendicular component Vzsrf with the target surface distance like that shown in FIG. 9, in other words, by carrying out setting in such a manner that the threshold of the perpendicular component Vzsrf monotonically decreases in response to reduction in the target surface distance.

Figure 10:
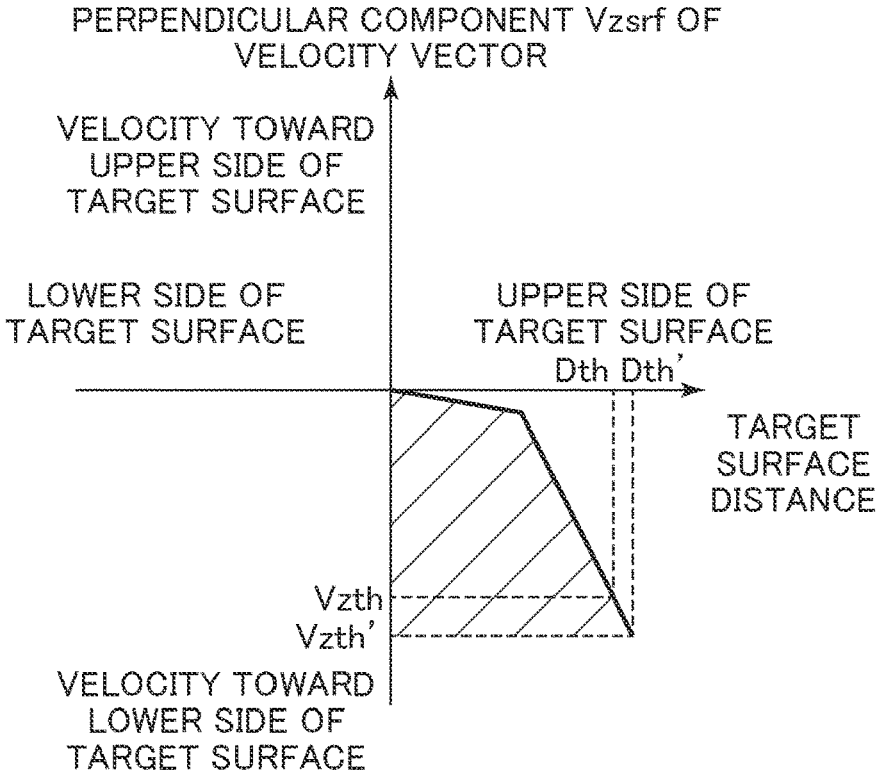
FIG. 10 is a diagram showing one example of the graph that defines the threshold.

Furthermore, the threshold of the perpendicular component Vzsrf of the velocity vector V in the step S104 and the threshold of the target surface distance in the step S105 may be changed according to the angle of the arm 9 with respect to the boom 8. In the state in which the arm cylinder 6 is operated in the contraction direction and the arm 9 stretches (that is, state in which the radius of swing is large), the moment of inertia is larger and it becomes more difficult to stop boom lowering operation. For this reason, it is preferable to change the threshold according to the angle of the arm 9. Specifically, it is preferable to set the magnitude of the threshold larger to cause warning issuance more readily in the state in which dumping operation of the arm 9 is being carried out through contraction of the arm cylinder 6 than in the state in which crowding operation of the arm 9 is being carried out through expanding the arm cylinder 6. For example, as shown in FIG. 10, when a threshold Vzth relating to the perpendicular component Vzsrf of the velocity vector is changed to Vzth' and a threshold Dth relating to the target surface distance is changed to Dth', the region of progression to the step 106 enlarges and warning issuance can be caused more readily. In addition, the boundary line between the hatching region and the non-hatching region in the fourth quadrant may be moved in such a direction as to increase the area of the hatching region (for example, right direction or upper right direction).

Moreover, the processing of the step S104 and the processing of the step S105 may be integrated to be executed as follows. A predicted time until the bucket 10 reaches the target surface 62 may be computed from the perpendicular component Vzsrf of the velocity vector V and the target surface distance and the processing may be caused to proceed to the step S106 when the predicted time has become equal to or shorter than a threshold. The predicted time in this case can be computed when the target surface distance is divided by the perpendicular component, for example.

The processing of the step S107 may be omitted from the flowchart of FIG. 8.

Second Embodiment

Next, an embodiment when excavation operation by the arm 9 is included will be described. Description of the part overlapping with the first embodiment is omitted.

Figure 11:
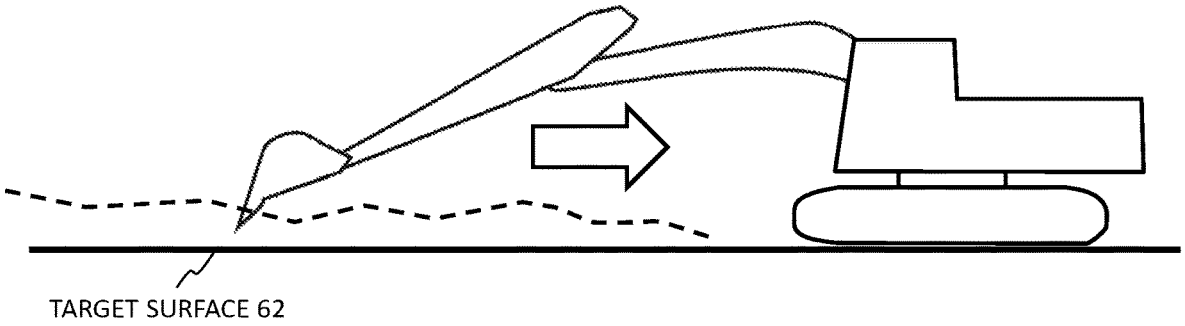
FIG. 11 is a diagram showing the hydraulic excavator that carries out linear excavating by arm operation.

As shown in FIG. 11, operation combined with the boom 8 is necessary in the case of causing the arm 9 to pivot in an excavation direction shown by an arrow in the diagram by arm crowding operation by an operator through the operation device 15 and forming the target surface 62 with a straight line shape. Specifically, raising operation or lowering operation of the boom 8 to cancel out the perpendicular component of the velocity vector of the tip of the bucket 10 with respect to the target surface 62, generated by crowding operation of the arm 9, is necessary. Specifically, when the perpendicular component of a velocity vector in the negative direction (vertical downward direction with respect to the target surface 62) arises due to the arm 9, it needs to be canceled out by raising operation of the boom 8. Conversely, when the perpendicular component of a velocity vector in the positive direction (vertical upward direction with respect to the target surface 62) arises, it needs to be canceled out by lowering operation of the boom 8.

Figure 12:
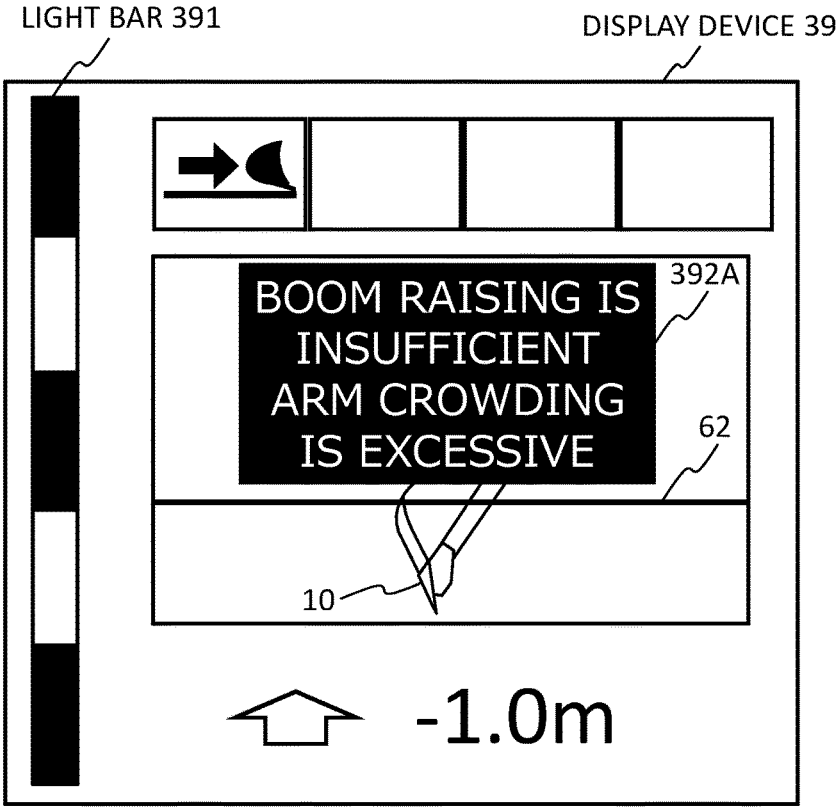
FIG. 12 is a diagram showing one example of the display screen of the display device.
Figure 13:
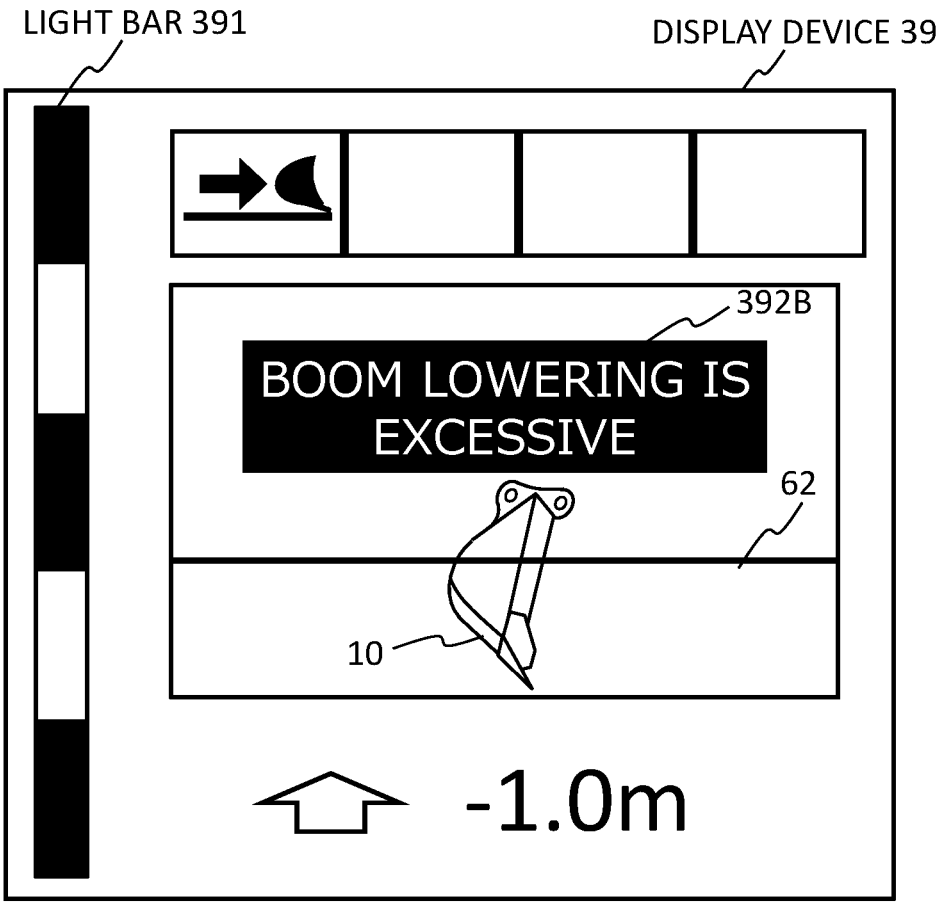
FIG. 13 is a diagram showing one example of the display screen of the display device.

In excavation operation of the arm 9, a display example when it is determined that the possibility of entry into the target surface 62 is high due to insufficiency of raising operation of the boom 8 is shown in FIG. 12. A display example when it is determined that the possibility of entry into the target surface 62 is high due to an excess of lowering operation of the boom 8 is shown in FIG. 13. This can notify the operator that the operation is excessive or insufficient, and can alleviate the entry of the bucket 10 into the target surface 62.

Figure 14:
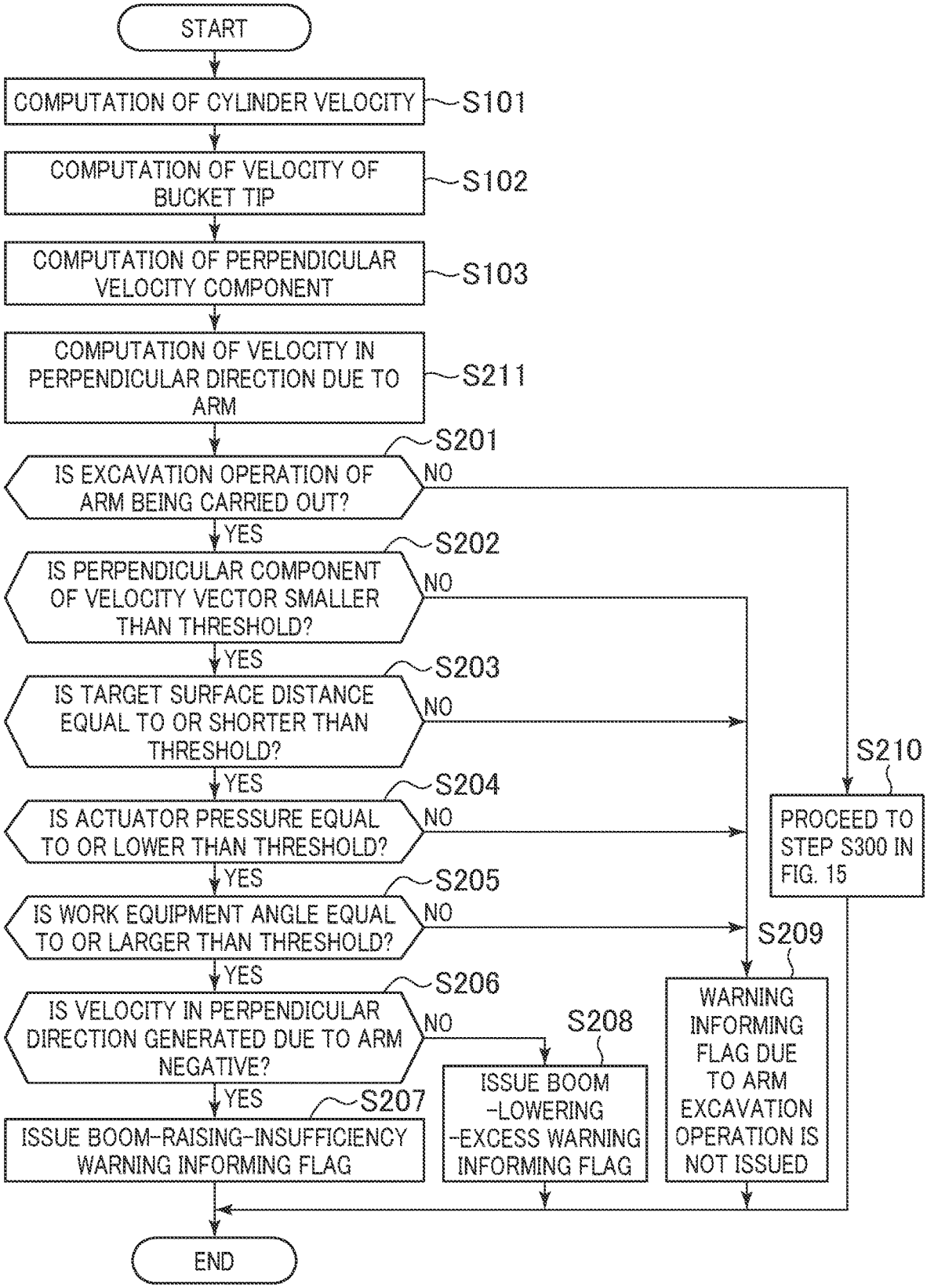
FIG. 14 is a control flow by the controller according to a second embodiment.

FIG. 14 shows a control flow by the controller 20 of the second embodiment. The controller 20 repeatedly executes the flow of FIG. 14 at a predetermined control cycle. When the processing is started, the work equipment velocity estimating section 29 executes computation processing of the velocity of the respective hydraulic cylinders 5, 6, and 7 (step S101), computation processing of the velocity vector V of the bucket tip (step S102), and computation processing of the perpendicular component Vzsrf of the velocity vector V (step S103) similarly to the flow of FIG. 8.

Next, in a step S211, the work equipment velocity estimating section 29 computes a velocity vector Va generated due to operation of the arm 9 based on dimension data of the boom 8 and the arm 9 and posture data thereof (boom angle signal and arm angle signal) and the velocity of the arm cylinder 6 in the step S101, and computes a perpendicular component Vazsrf of the velocity vector Va with respect to the target surface 62.

In a step S201, the guidance contents change section 31 determines whether excavation operation of the arm 9 is being carried out by the operator (that is, crowding operation thereof is being carried out) based on the arm operation signal. If it is determined that excavation operation of the arm 9 is being carried out here, the processing proceeds to a step S202.

In the step S202, the guidance contents change section 31 determines whether or not the perpendicular component Vzsrf of the velocity vector V of the bucket tip (bucket claw tip) is equal to or smaller than a threshold. The processing proceeds to a step S203 if it is determined that the perpendicular component Vzsrf is equal to or smaller than the threshold here, and the processing proceeds to a step S209 if this is not the case. The threshold relating to the perpendicular component Vzsrf in the step S202 may be made identical to the threshold relating to the step S104 in FIG. 8 or may be made different.

In the step S203, the guidance contents change section 31 determines whether or not the target surface distance is equal to or shorter than a threshold. The processing proceeds to a step S204 if it is determined that the target surface distance is equal to or shorter than the threshold here, and the processing proceeds to the step S209 if this is not the case. The threshold relating to the target surface distance in the step S203 may be made identical to the threshold relating to the step S105 in FIG. 8 or may be made different.

In the step S204, the guidance contents change section 31 determines whether or not the actuator pressure is equal to or lower than a threshold. The processing proceeds to a step S205 if the actuator pressure is equal to or lower than the threshold, and the processing proceeds to the step S209 if this is not the case. The threshold relating to the actuator pressure in the step S204 may be made identical to the threshold relating to the step S106 in FIG. 8 or may be made different.

In the step S205, the guidance contents change section 31 determines whether or not the angle formed by the bottom surface of the bucket 10 and the target surface (work equipment angle) is equal to or larger than a threshold. If the angle is smaller than the threshold, it is conceivable that pressing work is being carried out with the bottom surface of the bucket 10 by operation of the arm 9. The processing proceeds to a step S206 if the angle is equal to or larger than the threshold, and the processing proceeds to the step S209 if this is not the case. The threshold relating to the work equipment angle in the step S205 may be made identical to the threshold relating to the step S107 in FIG. 8 or may be made different.

In the step S206, the guidance contents change section 31 determines whether or not the perpendicular component Vazsrf of the velocity vector Va of the bucket 10 with respect to the target surface 62 generated due to the operation of the arm 9, calculated in the step S211, is negative. The processing proceeds to a step S207 if the perpendicular component Vazsrf is negative, and the processing proceeds to a step S208 if this is not the case (if the perpendicular component Vazsrf is zero or positive).

In the step S207, the guidance contents change section 31 determines that the possibility of entry into the target surface 62 is high due to insufficiency of raising operation of the boom 8 or excess of excavation operation of the arm 9, and issues a warning informing flag that informs that effect (boom-raising-insufficiency warning informing flag). A screen display example of the display device 39 when the boom-raising-insufficiency warning informing flag is input is shown in FIG. 12. In FIG. 12, a message 392A indicating that boom raising is insufficient or arm crowding is excessive is displayed due to the boom-raising-insufficiency warning informing flag. The operator can be notified that boom raising operation is insufficient or arm crowding operation is excessive by this message 392A, and the entry of the bucket 10 into the target surface 62 can be prevented by operation change by the operator who has recognized it. Although the operator is informed of both insufficiency of boom raising and excess of arm crowding by the message 392A in the example of FIG. 12, the operator may be informed of either one.

If it is determined that the velocity in the perpendicular direction generated due to the operation of the arm 9 is not negative in the step S206, the processing proceeds to the step S208.

In the step S208, the guidance contents change section 31 determines that lowering operation of the boom 8 is excessive and the possibility of entry into the target surface 62 is high, and issues a warning informing flag that informs that effect (boom-lowering-excess warning informing flag). A screen display example of the display device 39 when the boom-lowering-excess warning informing flag is input is shown in FIG. 13. In FIG. 13, a message 392B indicating that boom lowering is excessive is displayed due to the boom-lowering-excess warning informing flag. The operator can be notified that lowering operation of the boom 8 is excessive by the message 392B, and the entry of the bucket 10 into the target surface 62 can be prevented by operation change (reduction in boom lowering operation) by the operator who has recognized it.

The processing proceeds to the step S209 if the condition is not satisfied in any of the step S202, the step S203, the step S204, and the step S205. In the step S209, issuance of the warning informing flag due to excavation operation of the arm 9 is not carried out.

The processing proceeds to a step S210 if the condition is not satisfied in the step S201 (that is, excavation operation of the arm 9 is not being carried out). Processing in the case of the proceeding to the step S210 is shown in FIG. 15.

Figure 15:
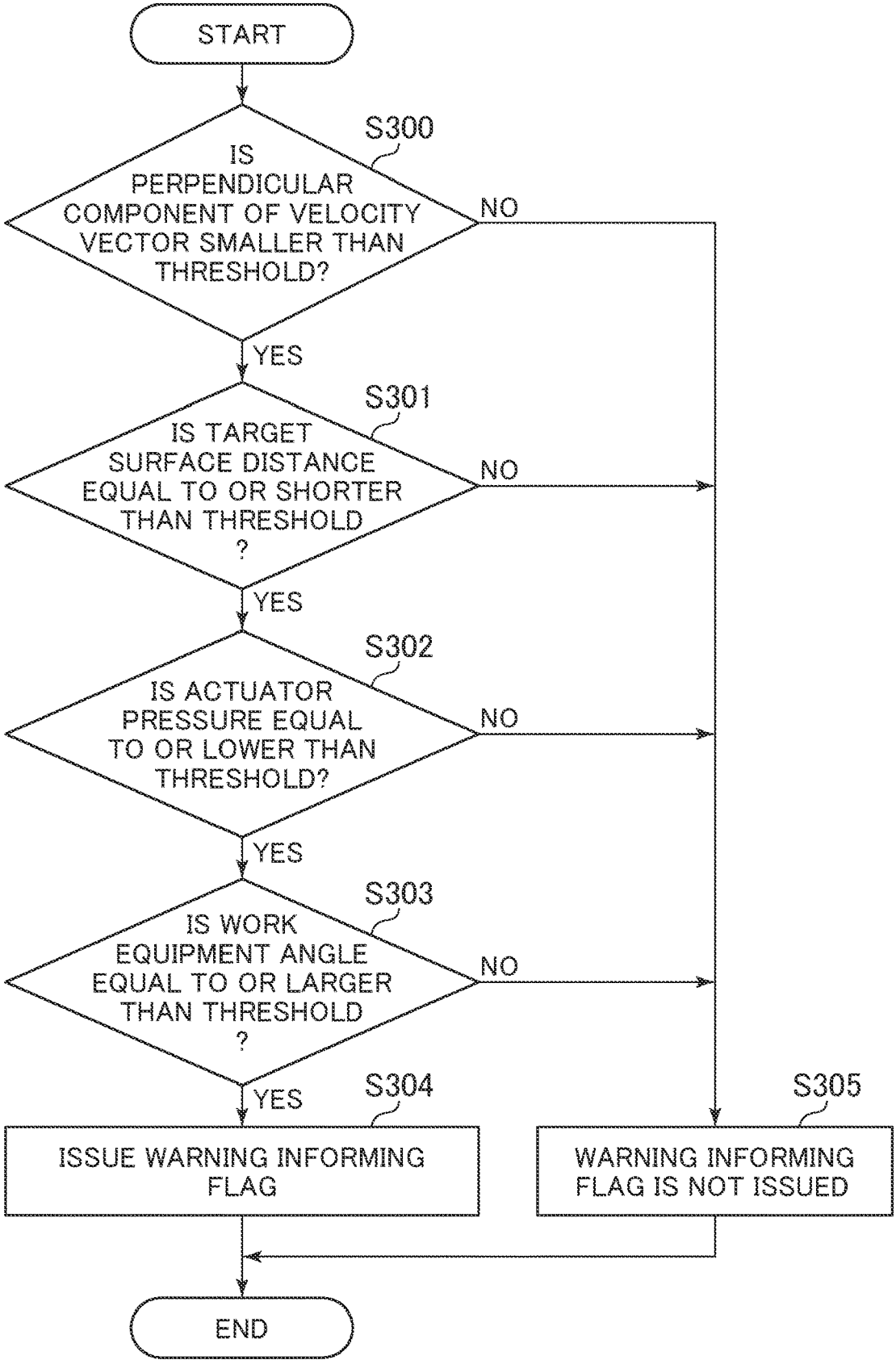
FIG. 15 is a control flow by the controller according to the second embodiment.

In FIG. 15, the guidance contents change section 31 executes processing of a step S300, a step S301, a step S302, a step S303, a step S304, and a step S305. These kinds of processing are each the same processing as the processing of the step S104, the step S105, the step S106, the step S107, the step S108, and the step S109 shown in FIG. 8 and therefore description thereof is omitted.

As described above, in the present embodiment, the contents of informing (contents of MG) by the informing device (display device 39) are changed according to whether or not arm operation through the operation device 15 exists. Specifically, the contents of informing to the operator are changed depending on the direction of the perpendicular velocity component Vazsrf generated due to arm operation. This allows the operator to carry out more appropriate operation in the situation in which combined operation of the boom 8 and the arm 9 is necessary. For example, in the situation of the step S207, the operator can recognize that boom raising operation is insufficient, and excavation along the target surface 62 is enabled by increasing the operation amount of the boom raising operation.

By the way, there are steps in which similar determination processing using the predetermined threshold is executed in the flow shown in FIG. 14 and the flow shown in FIG. 15. The thresholds of these steps may be made different. Furthermore, it is preferable to set the thresholds in such a manner that the determination result in each step becomes YES more readily (that is, warning informing flag is issued more readily) in the flow of FIG. 15 than in the flow of FIG. 14. For example, the target surface distance and the threshold are compared in the steps S203 and S301. The thresholds may be set to 100 mm in the step S203 and be set to 1000 mm in the step S301. Due to this, the excavation force is ensured in accordance with FIG. 14 at the time of excavating by the arm 9 and entry into the target surface 62 is surely prevented in accordance with FIG. 15 at the time of alignment work without arm operation. Thus, it becomes possible to carry out informing suitable for each work.

Third Embodiment

The present embodiment is a modification example of the first embodiment. The guidance contents change section 31 of the present embodiment is characterized by carrying out the following operation. When operation of the boom 8 through the operation device 15 exists, the guidance contents change section 31 computes the intersection of the movement locus of the claw tip of the bucket 10 ("locus D" to be described later) and the target surface 62 ("reaching point" to be described later) and carries out predictive calculation of a velocity vector Vtgt of the bucket claw tip at the intersection. Then, the guidance contents change section 31 changes the threshold of at least one of the step S104 and the step S105 in the first embodiment according to a component Vztgt perpendicular to the target surface 62 in the velocity vector Vtgt at the intersection and thereby changes the contents of informing by the informing device 38.

In alignment work by lowering operation of the boom 8, when the angles of the arm 9 and the bucket 10 do not change (that is, when operation to the arm 9 and the bucket 10 does not exist and only lowering operation of the boom 8 is carried out), the intersection of the locus D (see FIG. 16) drawn by the tip of the bucket 10 and the target surface 62, i.e. the reaching point on the target surface 62 of alignment work (hereinafter, often referred to as "reaching point"), can be computed before the bucket 10 reaches the target surface 62 or the current-state terrain profile 61. Specifically, computation can be carried out as follows, for example. When the angles of the arm 9 and the bucket 10 do not change, the tip of the bucket 10 at the time of lowering operation of the boom 8 moves to draw a circular arc that has the base end part of the boom 8 (pivot center) as the center and has the distance between the boom base end part and the bucket tip as the radius. Thus, the intersection of this circular arc and the target surface 62 becomes the reaching point.

Furthermore, the perpendicular component Vztgt (see FIG. 16) with respect to the target surface 62 in the velocity vector Vtgt (see FIG. 16) of the bucket claw tip at the reaching point can also be computed similarly to the perpendicular component Vzsrf in the step S103. Moreover, the threshold relating to the target surface distance in the step S105 and the threshold relating to the perpendicular component Vzsrf in the step S104 are changed according to the direction and magnitude of the perpendicular component Vztgt. This can prevent displaying of the unnecessary message 392 to the operator and improve usability of the MG.

Figure 16:
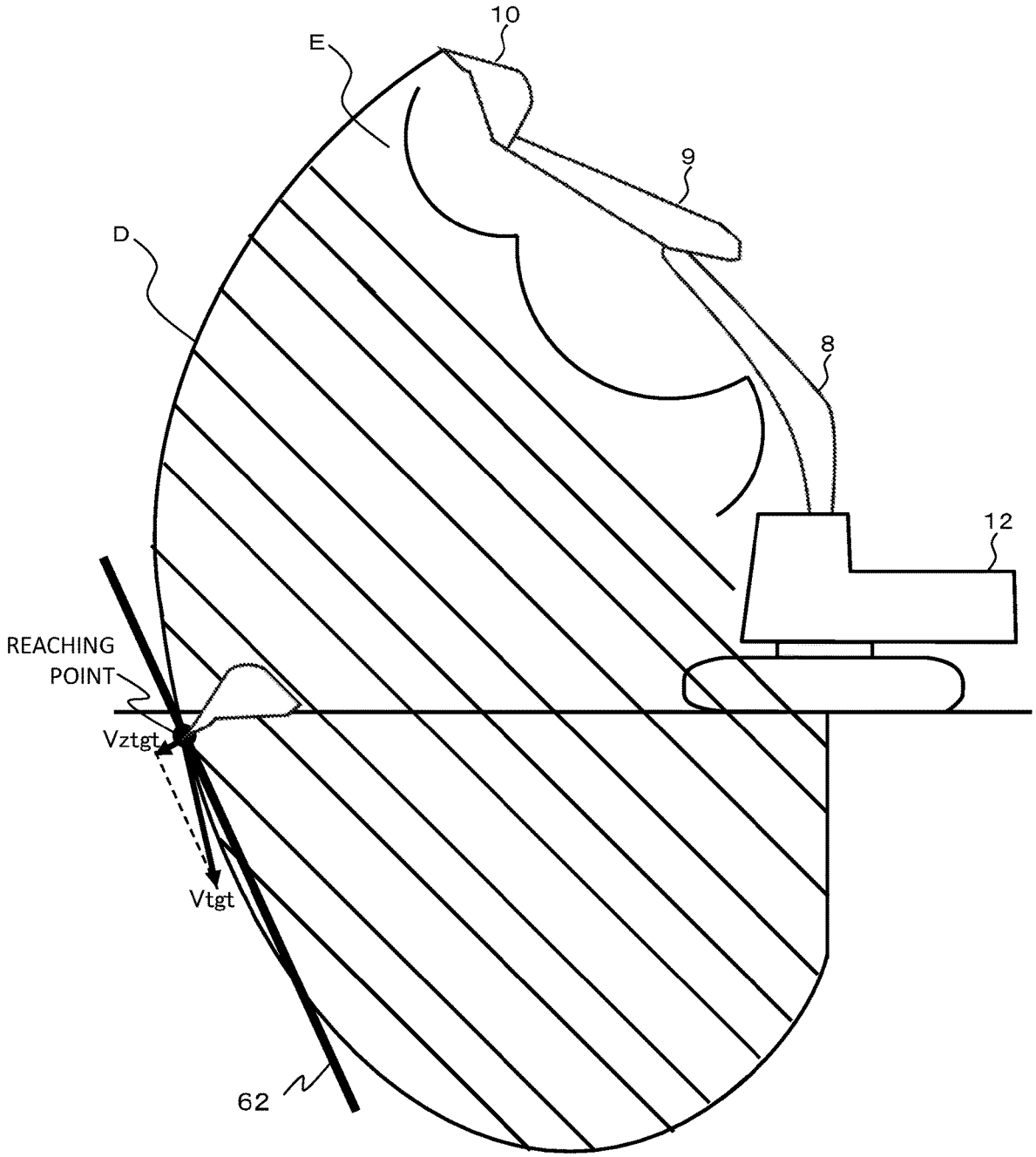
FIG. 16 is a diagram showing the locus of the bucket tip (circular arc D) and a target surface.

The movable range of the bucket 10 and the target surface 62 are shown in FIG. 16. A hatching part E shown by the region in which hatching is carried out is the movable range of the bucket 10. Furthermore, the circular arc D shows the locus of the tip of the bucket 10 with the posture of the arm 9 and the bucket 10 shown in FIG. 16. When the target surface 62 exists at a position like that shown in FIG. 16, the angle formed by the velocity vector Vtgt and the target surface 62 is comparatively small and the magnitude of the perpendicular component Vztgt thereof becomes comparatively small. For this reason, even when lowering operation of the boom 8 is fast, the amount of bucket entry into the target surface 62 becomes comparatively small. In this case, it will be reasonable to change the threshold of the step S104 or the step S105 in such a direction that informing of a warning is carried out less readily. For example, the threshold relating to the target surface distance in the step S105 in FIG. 8 in the first embodiment can be changed as in a graph shown in FIG. 17 according to the direction and magnitude of the perpendicular component Vztgt.

Figure 17:
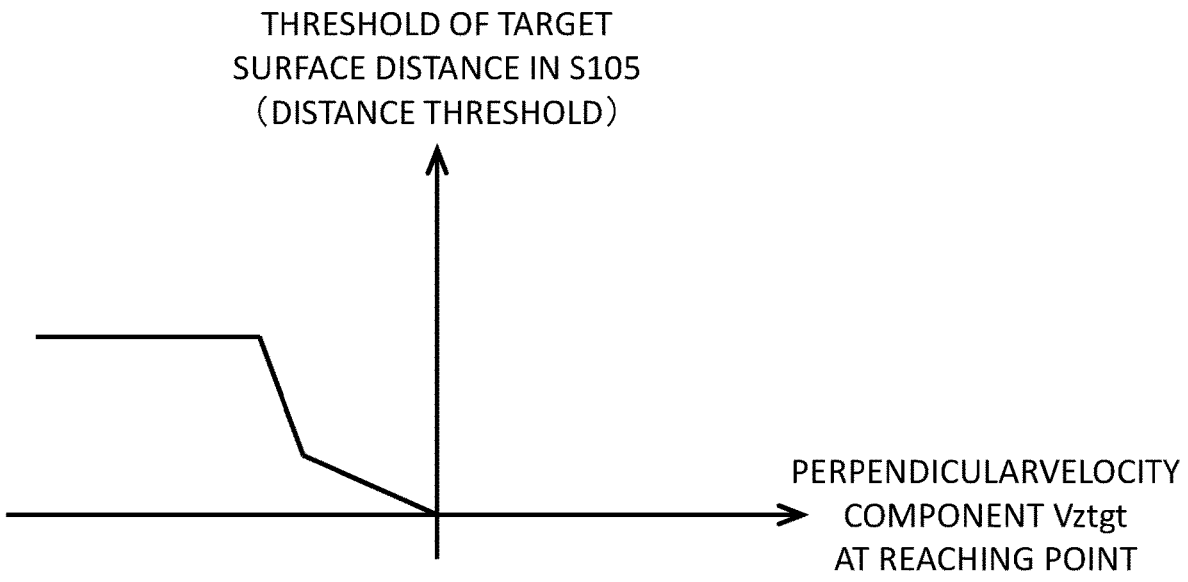
FIG. 17 is a diagram showing one example of a graph that defines a threshold.

The graph of FIG. 17 is what is obtained by plotting the perpendicular component Vztgt of the velocity vector Vtgt at the reaching point on the abscissa axis and plotting the threshold of the target surface distance (distance threshold) on the ordinate axis. The distance threshold is set in such a manner that, when the perpendicular component Vztgt of the velocity vector at the reaching point is negative, the distance threshold also increases according to increase in the magnitude thereof. If the distance threshold is set in this manner, the distance threshold becomes larger when the magnitude of the negative perpendicular component Vztgt is larger. Therefore, the warning informing flag is issued earlier than in the first embodiment as a result. On the other hand, the distance threshold becomes smaller when the magnitude of the negative perpendicular component Vztgt is smaller. Therefore, the warning informing flag is issued in the situation in which the bucket 10 has come closer to the target surface 62 than in the first embodiment as a result. Furthermore, when the perpendicular component Vztgt of the velocity vector Vtgt at the reaching point becomes zero or when the perpendicular component Vztgt is positive and the bucket 10 exists on the upper side relative to the target surface 62, the distance threshold may also be set to zero as shown in FIG. 17 and the warning informing flag may be always kept from being issued. Moreover, the warning informing flag may be always kept from being issued when the intersection of the locus (circular arc) D drawn by the tip of the bucket 10 and the target surface 62 does not exist.

Fourth Embodiment

Figure 18:
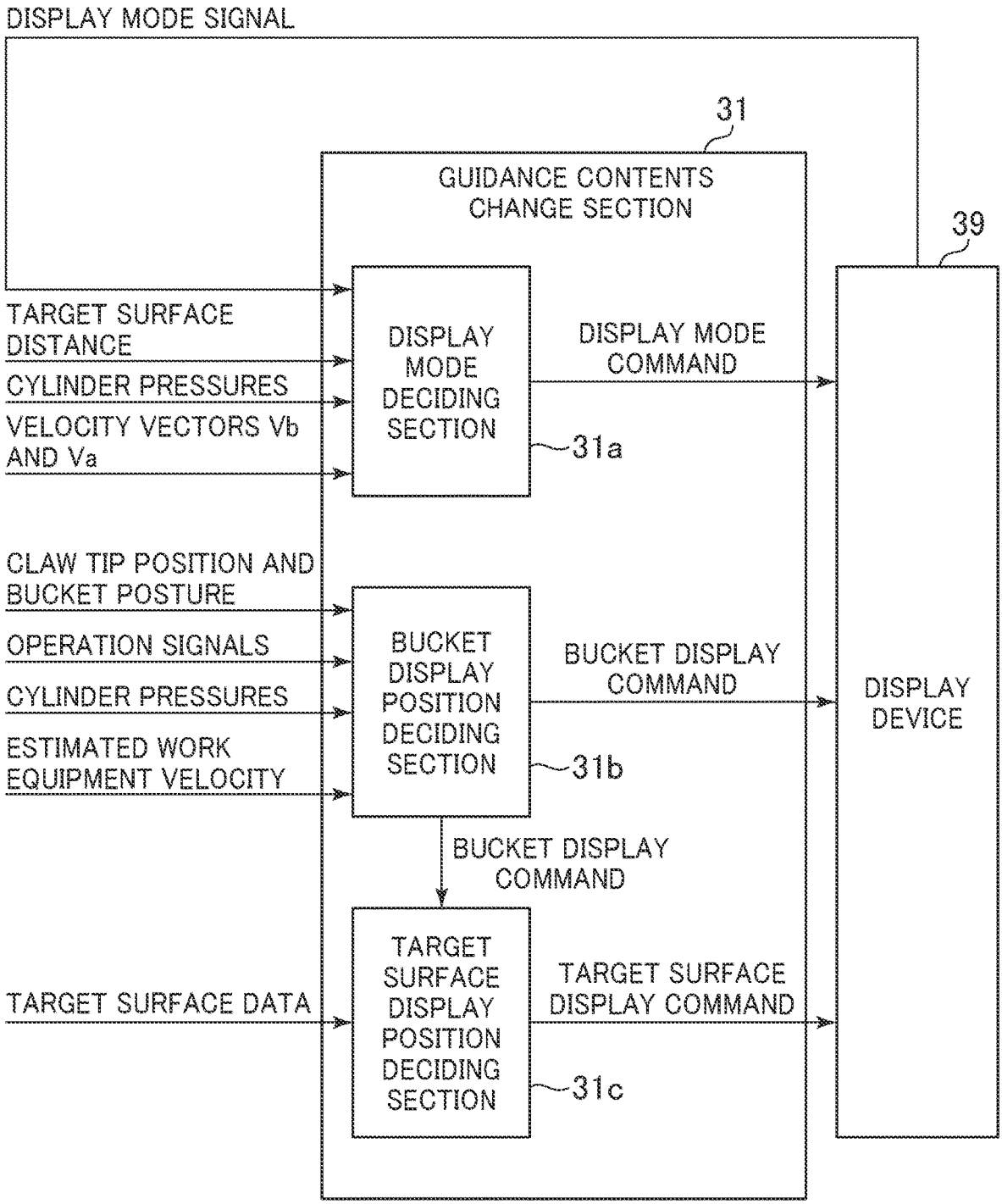
FIG. 18 is a functional block diagram of a guidance contents change section according to a fourth embodiment.

The present embodiment is different from the above respective embodiments in that the present embodiment includes the guidance contents change section 31 shown in FIG. 18. Description is omitted as appropriate regarding the same part as the above embodiment. The guidance contents change section 31 of the present embodiment includes a display mode deciding section 31*a*, a bucket display position deciding section 31*b*, and a target surface display position deciding section 31*c*.

Figure 20:
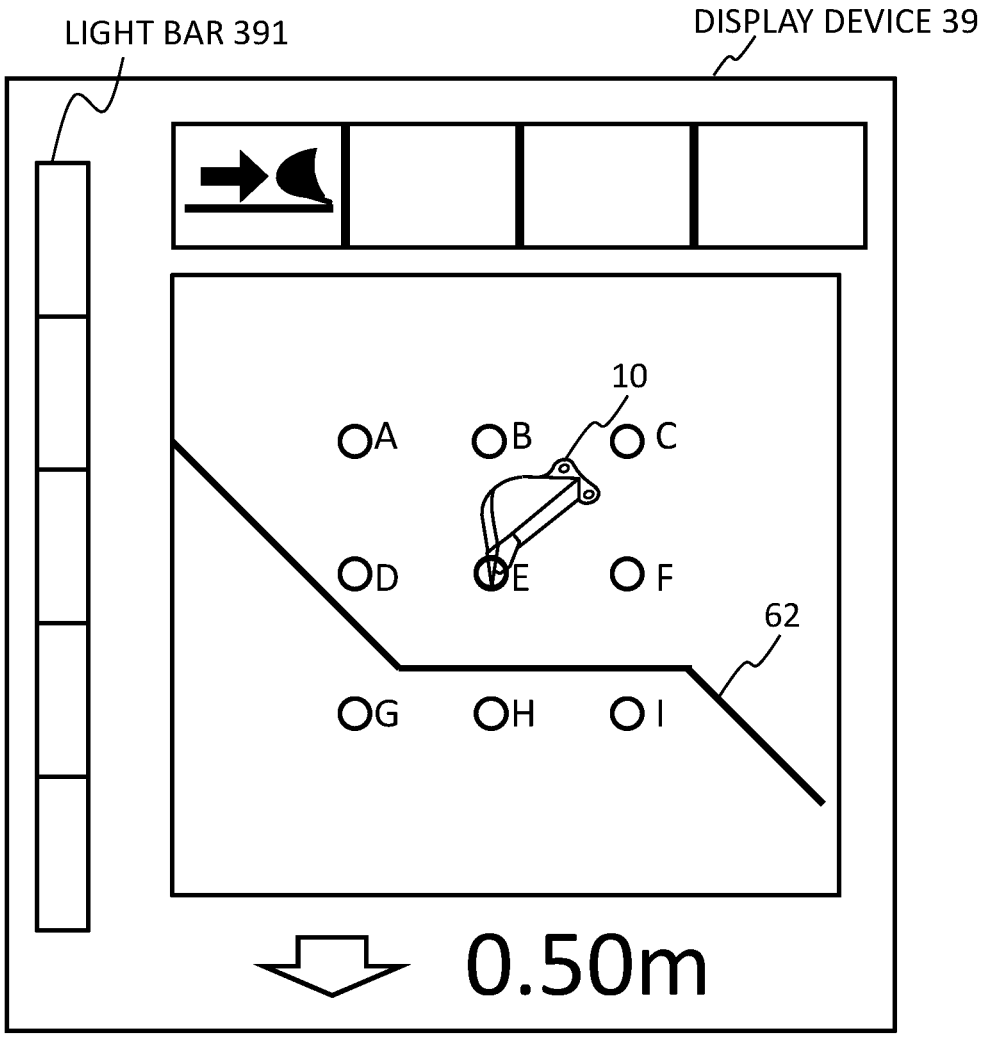
FIG. 20 is a diagram showing one example of the display screen (enlargement mode) of the display device.
Figure 21:
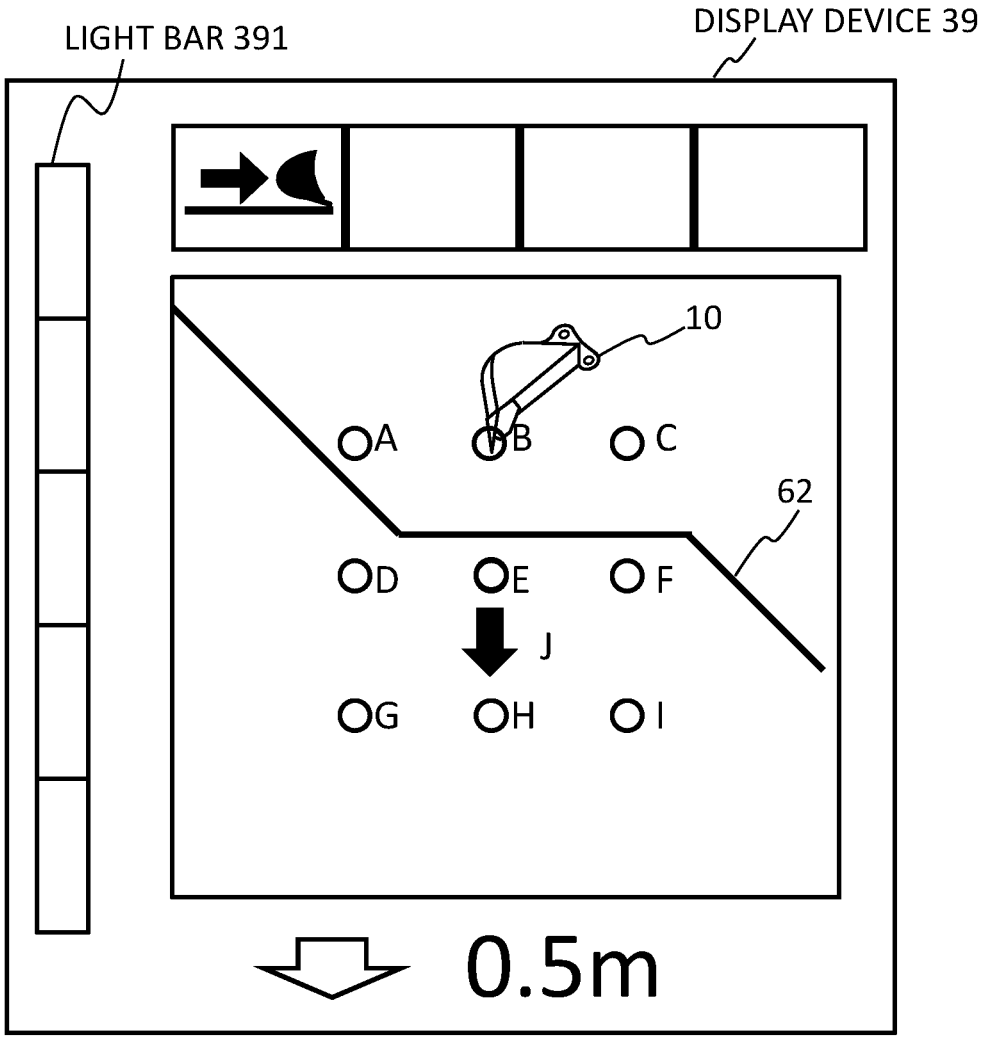
FIG. 21 is a diagram showing one example of the display screen (enlargement mode) of the display device.
Figure 22:
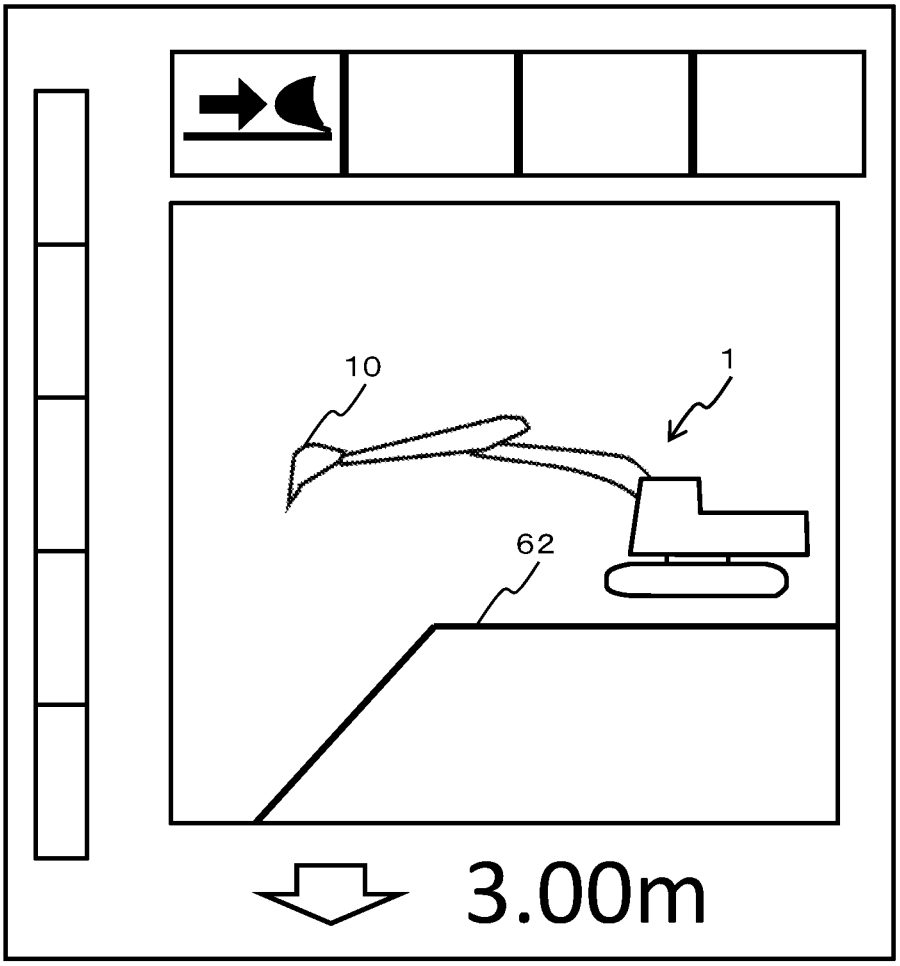
FIG. 22 is a diagram showing one example of the display screen (overall mode) of the display device.

The display mode deciding section 31*a* is a section that decides which of an enlargement mode (see FIGS. 20 and 21) and an overall mode (see FIG. 22) is selected as a display mode of a screen that displays the positional relationship between the bucket 10 and the target surface 62, according to a velocity vector Vb generated due to operation of the boom 8, the velocity vector Va generated due to operation of the arm 9, the target surface distance, and the pressure of the actuators 5, 6, and 7, and outputs the result thereof to the display device 39 as a display mode command. The bucket 10 and the target surface 62 are displayed in the screen in the enlargement mode (first screen) on the display device 39 as shown in FIGS. 20 and 21. Furthermore, in the screen in the overall mode (second screen), a wider range than the screen in the enlargement mode (first screen) is included and at least the whole of the hydraulic excavator 1 and the target surface 62 are displayed as shown in FIG. 22. To the display mode deciding section 31*a*, a signal showing the display mode in which displaying is currently carried out on the display device 39 (display mode signal) is input from the display device 39. Furthermore, the target surface distance is input from the target surface distance and work equipment angle calculating section 30, the pressures of the respective cylinders 5, 6, and 7 are input from the actuator state sensor 37, and the velocity vectors Vb and Va are input from the work equipment velocity estimating section.

The bucket display position deciding section 31*b* is a section that changes and decides the position at which an image of the bucket 10 is displayed on the screen of the display device 39 according to the velocity vector V, the target surface distance, and the pressures of the actuators 5, 6, and 7, and outputs the result thereof to the display device 39 as a bucket display command. To the bucket display position deciding section 31*b*, the position of the bucket claw tip and the posture of the bucket 10 are input from the work implement posture sensing section 28 and the operation signals to the boom 8, the arm 9, and the bucket 10 are input from the operator operation sensor 36. In addition, the pressures of the respective cylinders 5, 6, and 7 are input from the actuator state sensor 37 and the velocity vector V of the claw tip of the bucket 10 (estimated work equipment velocity) is input from the work equipment velocity estimating section.

The target surface display position deciding section 31*c* is a section that decides the position at which an image of the target surface 62 (line segment) is displayed on the screen of the display device 39 based on the bucket display command input from the bucket display position deciding section 31*b* and target surface data input from the target surface setting device 35, and outputs the result thereof to the display device 39 as a target surface display command.

The display device 39 controls the display mode of the screen showing the positional relationship between the bucket 10 and the target surface 62 based on the display mode command input from the display mode deciding section 31*a*. Furthermore, the display device 39 controls the display position of the bucket 10 in the screen based on the bucket display command input from the bucket display position deciding section 31*b* and controls the display position of the target surface 62 in the screen based on the target surface display command input from the target surface display position deciding section 31*c*.

In a site of excavating, not only the shape of the target surface 62 around the bucket but also the shape of the target surface 62 existing in the direction in which the bucket 10 is to be moved is desired to be grasped in advance in some cases. Meanwhile, in the case of shaping the current terrain profile into the target shape by the bucket 10, the target surface 62 is desired to be grasped in detail in some cases. In such a case, it is effective to change the positional relationship between the target surface 62 and the bucket 10 in the display screen of the display device 39 and vary the display magnification of the bucket 10 and the target surface 62 in the screen.

Figure 19:
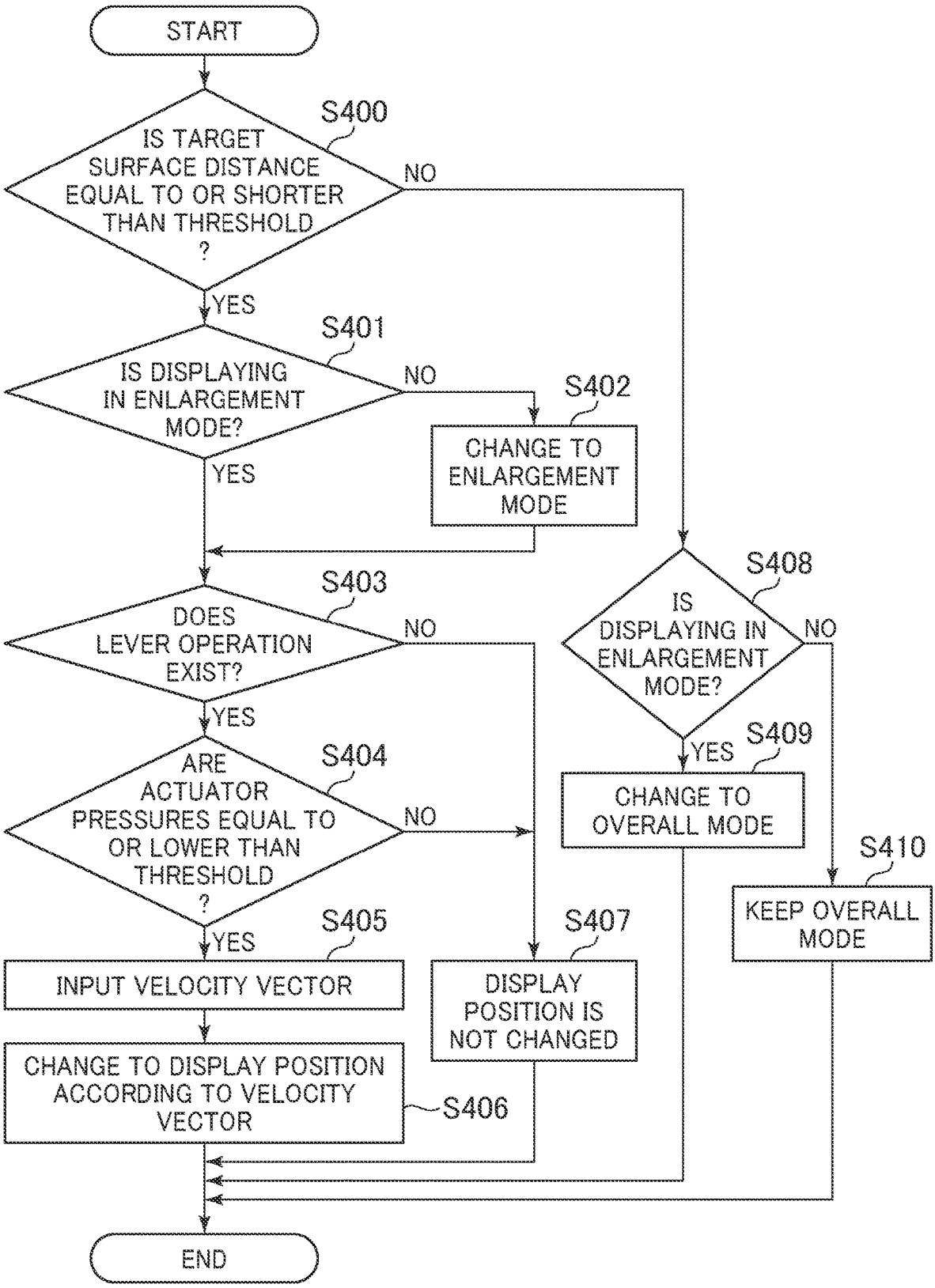
FIG. 19 is a control flow by the controller according to the fourth embodiment.

FIG. 19 is a flowchart of processing executed by the guidance contents change section 31 of the present embodiment. First, in a step S400, the display mode deciding section 31*a* determines whether the target surface distance is equal to or shorter than a threshold. If it is determined that the target surface distance is equal to or shorter than the threshold, the processing proceeds to a step S401.

In the step S401, the display mode deciding section 31*a* determines whether the current displaying is in the enlargement mode based on the display mode signal. The processing proceeds to a step S403 if it is determined that the current display mode is the enlargement mode. On the other hand, the processing proceeds to a step S402 if it is determined that the current display mode is not the enlargement mode.

In the step S402, the display mode deciding section 31*a* outputs the display mode command to change the display mode to the enlargement mode to the display device 39.

In the step S403, the bucket display position deciding section 31*b* determines whether lever operation aiming at operation of the work implement 1A by the operator exists based on the operation signal input from the operator operation sensor 36. The processing proceeds to a step S404 if it is determined that lever operation exists.

In the step S404, the bucket display position deciding section 31*b* determines whether all of pressures generated in the three hydraulic cylinders (actuators) 5, 6, and 7 are equal to or lower than a threshold set regarding each cylinder. If it is determined that the pressures of all cylinders 5, 6, and 7 are equal to or lower than the respective thresholds, the velocity vector V of the tip of the bucket 10 (same as the velocity V in the step S102 in FIG. 8) is input from the work equipment velocity estimating section 29 in a step S405. Then, in the next step S406, the bucket display position deciding section 31*b* decides to change the display position of the bucket 10 from a reference position (to be described later) and decides the bucket display position after the change based on the velocity vector V in the step S405. The processing of this step S406 will be described later.

The processing proceeds to a step S407 if it is determined that lever operation does not exist in the step S403 or if it is determined that at least one of the pressures of the three actuators 5, 6, and 7 exceeds the threshold in the step S404. In the step S407, the bucket display position deciding section 31*b* does not execute the processing relating to change in the display position of the bucket 10. That is, the display position of the bucket 10 in this case is the reference position.

Furthermore, the processing proceeds to a step S408 if it is determined that the target surface distance is longer than the threshold in the step S400. In the step S408, the display mode deciding section 31*a* determines whether or not the current display mode is the enlargement mode based on the display mode signal. If it is determined that the current display mode is the enlargement mode here, the processing proceeds to a step S409 and the display mode deciding section 31*a* outputs the display mode command to change the display mode to the overall mode to the display device 39. Conversely, if it is determined that the current display mode is not the enlargement mode (that is, if the current display mode is the overall mode), the processing proceeds to a step S410 and the display mode deciding section 31*a* outputs the display mode command to keep the overall mode to the display device 39.

In FIG. 20, an example of displaying in the enlargement mode when the processing has proceeded to the step S407 (when the bucket display position is not changed from the reference position) is shown. In FIG. 21, an example of displaying in the enlargement mode when the processing has proceeded to the step S406 (when the bucket display position has been changed from the reference position) is shown. Point A to point I shown in FIG. 20 and FIG. 21 are points for explanation that are not displayed on the actual screen. Furthermore, arrow J shown in FIG. 21 is an arrow for explanation that is not displayed on the actual screen.

FIG. 20 is the screen of the enlargement mode and is the case in which the bucket display position is not changed. When the bucket display position is not changed, the bucket display position deciding section 31*b* displays the bucket 10 in such a manner that the claw tip position corresponds with reference point E located at the center of the display part, and the target surface display position deciding section 31*c* displays the target surface 62 based on the position of the bucket 10.

The processing of the step S406 will be described. FIG. 21 is the case in which the display mode is the enlargement mode and the bucket display position is changed. When the velocity vector V input in the step S405 in FIG. 19 is in the direction of arrow J in FIG. 21, the bucket display position deciding section 31*b* displays the bucket 10 in such a manner that the bucket tip position corresponds with the point existing in the direction of the vector that has reference point E as the initial point and is obtained by multiplying arrow J by a minus, i.e. point B in FIG. 21, and the target surface display position deciding section 31*c* displays the target surface 62 based on the position of the bucket 10. Changing the display position of the bucket 10 in this manner makes it possible to present the target surface 62 existing in the direction in which the bucket 10 moves to the operator more widely. Although nine points of point A to point I are employed as the bucket display position in the example of FIGS. 20 and 21, all of these points do not necessarily need to be used as the bucket display position. For example, a format may be employed in which four points of point B, point H, point D, and point F existing in the upward, downward, left, and right directions with respect to reference point E are used as the bucket display position together with reference point E.

Due to configuring the guidance contents change section 31 in this manner, when lever operation exists and the pressures of the three actuators 5, 6, and 7 are all equal to or lower than the threshold, the processing proceeds to the step S406 and therefore the shape of the target surface 62 located in the direction in which the bucket 10 moves is displayed more widely. Furthermore, when the pressure of any actuator 5, 6, or 7 is higher than the threshold, the processing proceeds to the step S407 and therefore the bucket display position is kept at reference point E even when lever operation exists. Thus, for example, when the display position of the bucket 10 is not changed from reference point E even when lever operation is carried out in the case in which the thresholds of the pressures of the respective actuators 5, 6, and 7 in the step S404 are set to the relief pressures of the respective actuators 5, 6, and 7, the operator can intuitively grasp that the pressure of any of the actuators 5, 6, and 7 has reached the relief pressure.

In the above-described example, the pressures of the three hydraulic cylinders 5, 6, and 7 and the threshold are compared in the determination of the step S404. However, instead of this, the pressure of the specific hydraulic cylinder (for example, arm cylinder 6) and the threshold corresponding to it (for example, relief pressure) may be compared. When the hydraulic cylinder whose pressure is determined in the step S404 is decided in advance as above, the operator can grasp that the hydraulic cylinder has reached the relief pressure (threshold) if the display position of the bucket 10 does not change from reference point E even when lever operation is carried out.

An example of displaying in the overall mode is shown in FIG. 22. In the overall mode, displaying is carried out in such a manner that the positions of the whole of the excavator and the target surface 62 are understood. Displaying in this manner allows the operator to easily grasp the positional relationship between the excavator 1 and the target surface 62.

Modification Example 1

Figure 23:
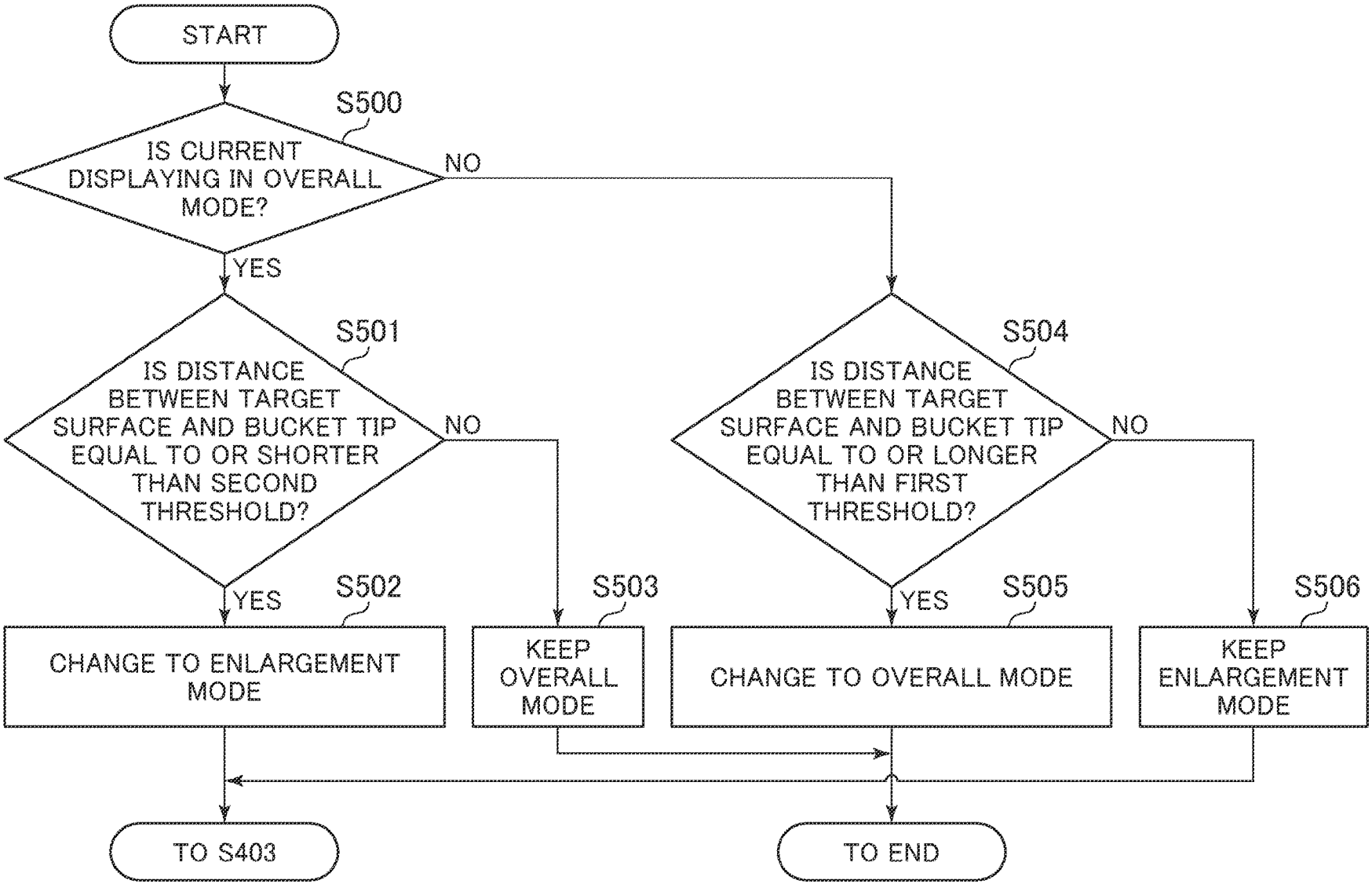
FIG. 23 is a control flow by the controller according to modification example 1 of the fourth embodiment.

In the flow of FIG. 19, the display mode is switched according to whether the target surface distance is longer or shorter than one threshold in the step S400. However, two different thresholds may be set and the threshold in the case of switching to the enlargement mode may be set smaller than the threshold in the case of switching to the overall mode. Specifically, a first threshold and a second threshold smaller than the first threshold are set as the thresholds relating to the target surface distance and processing of a flowchart shown in FIG. 23 is executed. The guidance contents change section 31 (controller 20) repeatedly carries out the flow of FIG. 23 at a predetermined control cycle.

First, in a step S500, the display mode deciding section 31*a* determines whether or not the current displaying is in the overall mode based on the display mode signal. The processing proceeds to a step S501 if it is determined that the current display mode is the overall mode.

In the step S501, the display mode deciding section 31*a* determines whether or not the target surface distance is equal to or shorter than the second threshold. If it is determined that the target surface distance is equal to or shorter than the second threshold, the processing proceeds to a step S502 and the display mode deciding section 31*a* outputs the display mode command to change the display mode to the enlargement mode. If it is determined that the target surface distance is not equal to or shorter than the second threshold in the step S501 (that is, if the target surface distance is longer than the second threshold), the processing proceeds to a step S503 and the display mode deciding section 31*a* keeps the overall mode.

On the other hand, if it is determined that the current display mode is not the overall mode in the step S500, the processing proceeds to a step S504 and the display mode deciding section 31*a* determines whether or not the target surface distance is equal to or longer than the first threshold. If it is determined that the target surface distance is equal to or longer than the first threshold, the processing proceeds to a step S505 and the display mode deciding section 31*a* outputs the display mode command to change the display mode to the overall mode. If it is determined that the target surface distance is not equal to or longer than the first threshold in the step S504 (that is, if the target surface distance is shorter than the first threshold), the processing proceeds to a step S506 and the display mode deciding section 31*a* keeps the enlargement mode.

If the processing proceeds to the step S502 or the step S506 (that is, if the display mode is the enlargement mode), the controller 20 proceeds to the processing of the step S403 in the flowchart shown in FIG. 19. On the other hand, if the processing proceeds to the step S503 or the step S505 (that is, if the display mode is the overall mode), the controller 20 ends the processing and waits until the next control cycle.

According to the flowchart shown in FIG. 23, change from the overall mode to the enlargement mode is carried out when the target surface distance has become equal to or shorter than the second threshold, and change from the enlargement mode to the overall mode is carried out when the target surface distance has become equal to or longer than the first threshold. This can prevent the occurrence of frequent switching between the enlargement mode and the overall mode and reduce annoyance given to the operator.

Modification Example 2

Figure 24:
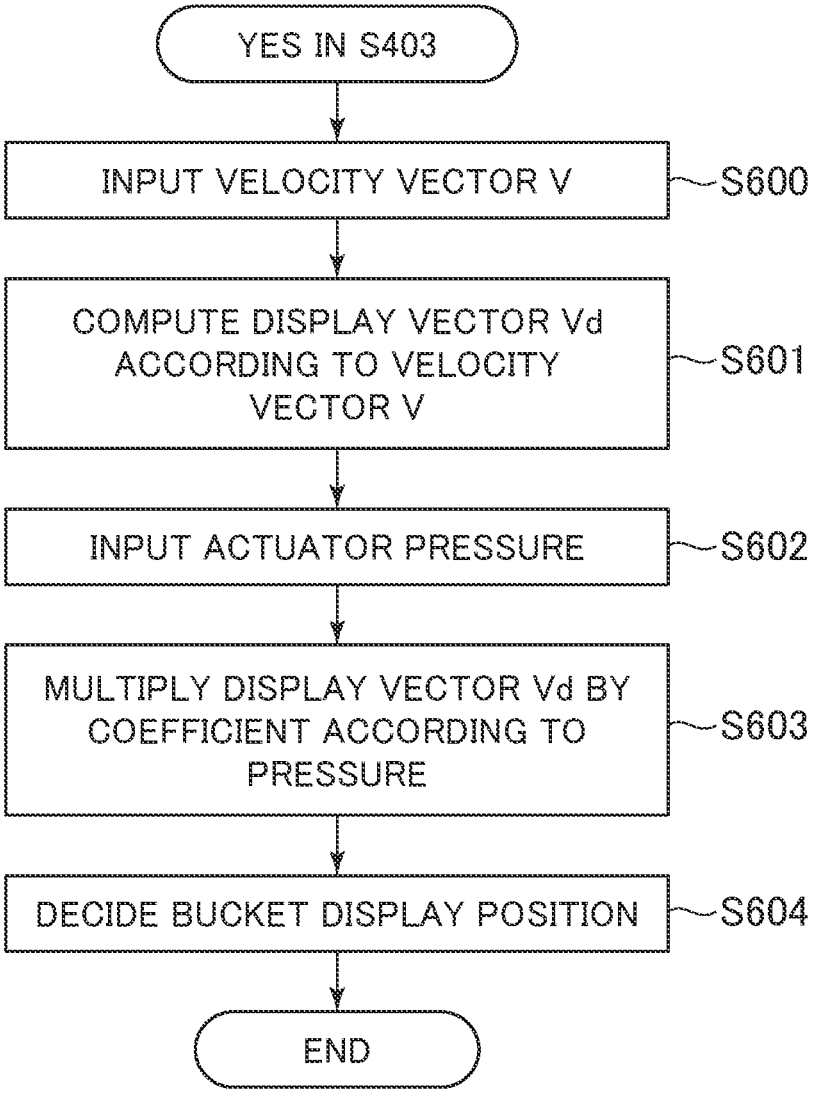
FIG. 24 is a control flow by the controller according to modification example 2 of the fourth embodiment.

If it is determined that lever operation exists in the step S403 in FIG. 19, a flowchart shown in FIG. 24 may be started instead of the step S404 in FIG. 19.

When the flow of FIG. 24 is started, the velocity vector V of the bucket claw tip based on operator operation is input to the bucket display position deciding section 31*b* in a step S600. In the next step S601, the bucket display position deciding section 31*b* computes a display vector Vd according to the velocity vector V. The display vector Vd is the vector that is obtained by multiplying the velocity vector V by a minus and has reference point E as the initial point.

Figure 25:
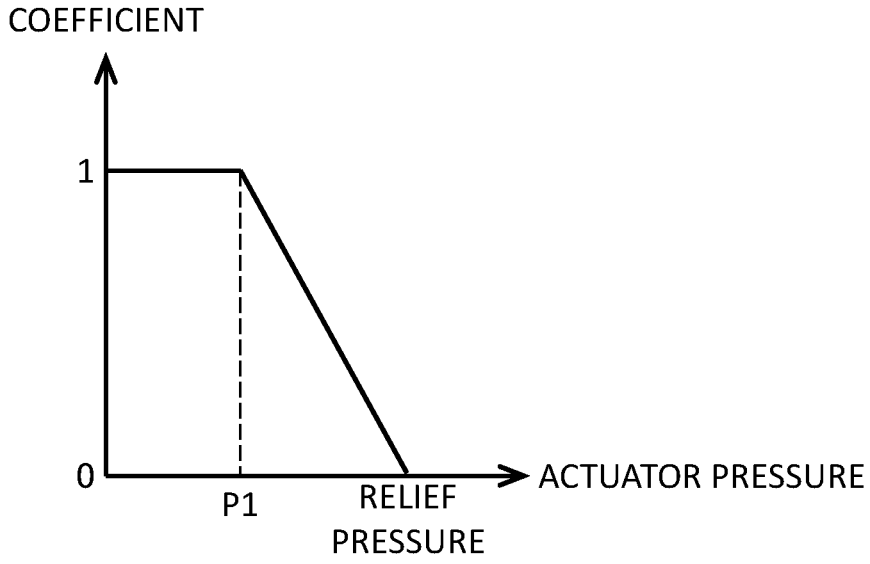
FIG. 25 is a diagram showing one example of a graph that defines a coefficient.

In a step S602, the pressure of the arm cylinder 6 (actuator pressure) is input from the actuator state sensor 37 to the bucket display position deciding section 31*b*. In a step S603, the bucket display position deciding section 31*b* multiplies the display vector Vd computed in the step S601 by a coefficient equal to or lower than 1 according to the actuator pressure acquired in the step S602. A correlation diagram between the actuator pressure and the coefficient is shown in FIG. 25. In the table of this diagram, the coefficient is set to monotonically decrease in response to increase in the actuator pressure. Specifically, when the actuator pressure is lower than a predetermined value P1, 1 is output as the coefficient. When this pressure is equal to or higher than the predetermined value P1 and is lower than the relief pressure, a value that monotonically decreases toward 0 as this pressure increases is output as the coefficient. When this pressure is equal to or higher than the relief pressure, 0 is output as the coefficient. That is, when the actuator pressure is lower than P1, the display vector Vd becomes a vector that conforms to the magnitude of the velocity vector V because the coefficient is 1. When the actuator pressure is equal to or higher than P1, the magnitude of the display vector Vd becomes smaller as the pressure increases.

In a step S604, the bucket display position deciding section 31*b* decides the terminal point of the display vector Vd acquired in the step S603 as the bucket display position and outputs the bucket display command corresponding to the position to the display device 39. That is, the display vector Vd in the present modification example indicates the movement amount of the bucket display position from reference point E. For example, as shown in FIG. 21, when the terminal point of the display vector Vd in the step S601 according to the velocity vector V is point B shown in FIG. 21, the terminal point of the display vector Vd in the step S603 becomes any point on the line segment that links reference point E and point B and the claw tip of the bucket 10 is displayed at the terminal point thereof. For example, when the actuator pressure is an intermediate value between the relief pressure and P1, the coefficient becomes 0.5. Therefore, the magnitude of the display vector Vd becomes half the magnitude when the actuator pressure is lower than P1 and the claw tip of the bucket 10 is displayed at the middle between reference point E and point B. Changing the bucket display position according to the magnitude of the actuator pressure in this manner allows the operator to intuitively grasp the magnitude of the load acting on the corresponding actuator (arm cylinder 6).

In the above description, the coefficient of the step S603 is computed based on the pressure of the arm cylinder 6. However, the coefficient may be decided based on the pressure of another hydraulic cylinder 5 or 7 or the coefficient may be decided from the pressures of plural hydraulic cylinders 5, 6, and 7.

Modification Example 3

Figure 26:
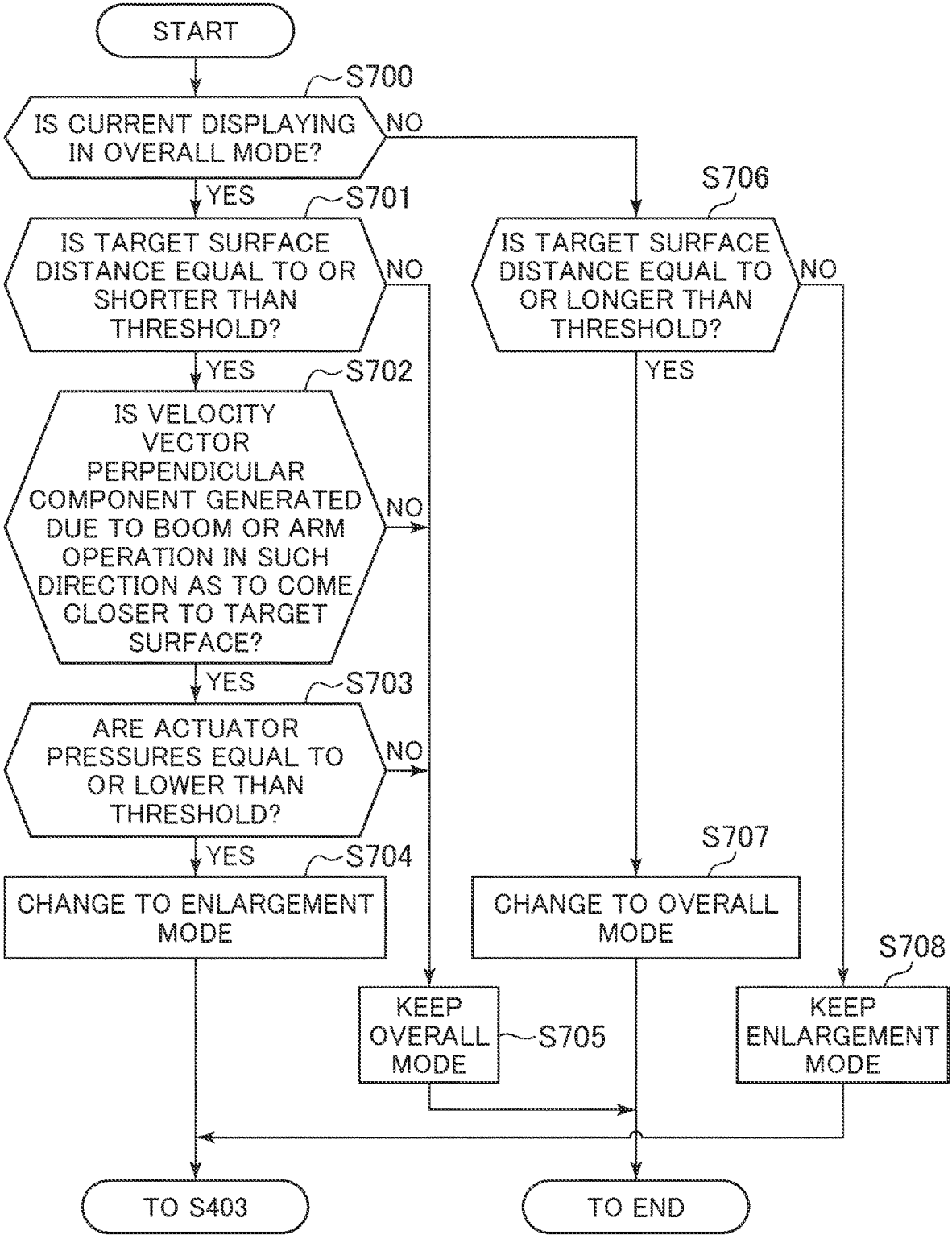
FIG. 26 is a control flow by the controller according to modification example 3 of the fourth embodiment.

In the flow of FIG. 19, the display mode is switched according to whether the target surface distance is longer or shorter than the threshold in the step S400. However, the display mode may be switched according to the direction of the perpendicular component Vbzsrf or Vazsrf with respect to the target surface 62 in the velocity vector Vb or Va generated due to operation of the boom 8 or the arm 9. A flowchart in this case is shown in FIG. 26. The guidance contents change section 31 (controller 20) repeatedly carries out the flow of FIG. 26 at a predetermined control cycle.

First, in a step S700, the display mode deciding section 31*a* determines whether the current display mode is the overall mode based on the display mode signal. The processing proceeds to a step S701 if the current display mode is the overall mode.

In the step S701, the display mode deciding section 31*a* determines whether the target surface distance is equal to or shorter than a threshold. The threshold is a value for determining whether or not the bucket claw tip has come close to the target surface 62. The processing proceeds to a step S702 if the target surface distance is equal to or shorter than the threshold.

In the step S702, the display mode deciding section 31*a* determines whether the perpendicular component Vbzsrf or Vazsrf of the velocity vector Vb or Va generated due to operation of the boom 8 or the arm 9 is in such a direction as to come closer to the target surface 62. The velocity vector Vb generated due to operation of the boom 8 is computed by the work equipment velocity estimating section 29 based on the dimension data of the boom 8 and the posture data thereof (boom angle signal) and the velocity of the boom cylinder 5. The work equipment velocity estimating section 29 also computes the perpendicular component Vbzsrf of the velocity vector Vb with respect to the target surface 62. Furthermore, the velocity vector Va generated due to operation of the arm 9 is also computed by the work equipment velocity estimating section 29 based on the dimension data of the boom 8 and the arm 9 and the posture data thereof (boom angle signal and arm angle signal) and the velocity of the arm cylinder 6. The work equipment velocity estimating section 29 also computes the perpendicular component Vazsrf of the velocity vector Va with respect to the target surface 62. The processing proceeds to a step S703 if it is determined that the perpendicular component Vbzsrf or Vazsrf is in such a direction as to come closer to the target surface 62 (that is, negative direction) in the step S702.

In the step S703, the display mode deciding section 31*a* determines whether or not the pressures of the actuators (hydraulic cylinders) 5, 6, and 7 are all equal to or lower than a threshold. The thresholds can be set to the same values as the step S404 in FIG. 19. If it is determined that the actuator pressures are all equal to or lower than the threshold, the processing proceeds to a step S704 and the display mode deciding section 31*a* outputs the display mode command to change the display mode to the enlargement mode to the display device 39.

On the other hand, when it is determined that the target surface distance is not equal to or shorter than the threshold in the step S701, when it is determined that the perpendicular component Vbzsrf or Vazsrf is not in such a direction as to come closer to the target surface 62 in the step S702, or when it is determined that any of the actuator pressures is higher than the threshold in the step S703, the processing proceeds to a step S705 and the display mode deciding section 31*a* keeps the display mode to the overall mode.

By the way, the processing proceeds to a step S706 if it is determined that the current display mode is not the overall mode in the step S700. In the step S706, the display mode deciding section 31*a* determines whether the target surface distance is equal to or longer than a threshold. The threshold may be set to the same value as the step S701 or may be set to a value larger than the value of the step S701. The processing proceeds to a step S707 if the target surface distance is equal to or longer than the threshold.

In the step S707, the display mode deciding section 31*a* changes the display mode to the overall mode. If it is determined that the target surface distance is shorter than the threshold in the step S706, the processing proceeds to a step S708 and the display mode deciding section 31*a* keeps the display mode to the enlargement mode.

When displaying is switched in this manner, change in the display mode in conformity to the work intention of the operator is enabled. For example, the case in which the processing proceeds to the step S704 is when the operator is trying to bring the bucket 10 close to the target surface 62 and is the situation in which earth and sand that yield excavation resistance are absent on the upper side relative to the target surface 62, that is, the situation in which finishing work is started. In such a case, it is preferable in terms of work to carry out displaying that allows the positional relationship between the bucket claw tip and the target surface 62 to be grasped in detail by making change from the overall mode to the enlargement mode. On the other hand, the case in which the processing proceeds to the step S705 via the step S703 is the state in which the operator is trying to bring the bucket 10 close to the target surface 62 but earth and sand that yield excavation resistance exist on the upper side of the target surface and the bucket 10 can not come sufficiently close to the target surface 62. At such time, minute work like finishing work is not carried out and therefore it is better that the positional relationship between the whole of the excavator and the target surface 62 can be grasped. Furthermore, the case in which the processing proceeds to the step S707 is the situation in which the distance between the bucket 10 and the target surface 62 is long and therefore it is better to make a transition from the enlargement mode to the overall mode. The case in which the processing proceeds to the step S708 is the situation in which the distance between the bucket 10 and the target surface 62 is short and therefore it is better to keep the enlargement mode.

The determination of the direction of the perpendicular component in the step S702 may be carried out by using the direction of the perpendicular component Vzsrf of the velocity vector V.

Furthermore, for the determination of whether or not lever operation exists in the step S403 in FIG. 19 and so forth, whether the pilot pressure (operation signal) is equal to or higher than a threshold may be used. Alternatively, the determination may be carried out by attaching potentiometer, encoder, and so forth to the operation device 15 and directly detecting the operation amount of the lever.

<Others>

The present invention is not limited to the above-described respective embodiments and various modification examples in such a range as not to depart from the gist thereof are included. For example, the present invention is not limited to what includes all configurations explained in the above-described respective embodiments, and what is obtained by deleting part of the configurations and what is obtained by replacing part of the configurations are also included.

In the step S107 in FIG. 8, the pressure of the actuator 5, 6, or 7 of the operation target and the threshold are compared. However, the pressure of the actuator 5, 6, or 7 that is not the operation target and the threshold may be compared to carry out determination. Furthermore, the threshold may be made different for each of the actuators 5, 6, and 7.

In the above-described respective embodiments, the loads are selected as the states of the hydraulic cylinders (actuators) 5, 6, and 7 and the pressures of the hydraulic cylinders 5, 6, and 7 are detected for detecting the loads. However, the delivery pressure of the hydraulic pump 2 may be detected, and a rough tendency of the load acting on the respective hydraulic cylinders 5, 6, and 7 may be grasped from the detected value and the result thereof may be reflected in the MG.

In the explanation of the above-described respective embodiments, as control lines and information lines, what are understood as necessary for the description of these embodiments are shown. However, all control lines and information lines relating to products are not necessarily shown. It may be thought that actually almost all configurations are mutually connected.

Regarding the respective configurations relating to the above-described controller 20, functions and execution processing of these respective configurations, and so forth, part or all of them may be implemented by hardware (for example, logic that carries out the respective functions is designed with an integrated circuit, and so forth). Furthermore, as the configuration relating to the above-described controller 20, a program (software) that is read out and executed by a calculation processing device (for example, CPU) to cause implementation of the respective functions relating to the configuration of the controller 20 may be employed. Data relating to this program can be stored in semiconductor memory (flash memory, SSD, and so forth), magnetic storing device (hard disk drive and so forth), recording medium (magnetic disc, optical disc, and so forth), and so forth, for example.

DESCRIPTION OF REFERENCE CHARACTERS

1: Hydraulic excavator
1A: Front work implement (work implement)
1B: Machine body
2: Hydraulic pump
5: Boom cylinder (actuator)
6: Arm cylinder (actuator)
7: Bucket cylinder (actuator)
8: Boom
9: Arm
10: Bucket
11: Lower track structure
12: Upper swing structure
13: Travelling lever
14: Operation lever
15: Operation device
17: GNSS antenna
20: Controller (controller)
21: Boom angle sensor
22: Arm angle sensor
23: Bucket angle sensor
24: Machine body inclination angle sensor
25: Boom cylinder pressure sensor
26: Arm cylinder pressure sensor
27: Bucket cylinder pressure sensor
28: Work implement posture sensing section
29: Work equipment velocity estimating section
30: Target surface distance and work equipment angle calculating section (angle calculating section)
31: Guidance contents change section
31*a*: Display mode deciding section
31*b*: Bucket display position deciding section
31*c*: Target surface display position deciding section
34: Work implement posture sensor
35: Target surface setting device
36: Operator operation sensor
37: Actuator state sensor
38: Informing device
39: Display device
40: Sound output device
62: Target surface
391: Light bar
392: Warning message

The invention claimed is:

1. A work machine including
an articulated work implement including work equipment,
an actuator that drives the work implement,
an operation device that makes an instruction of operation of the actuator,
a controller configured to calculate a position of the work implement and calculate a distance between the work equipment and a predetermined target surface and calculate a positional relationship between the work equipment and the target surface, and
an informing device that informs the positional relationship between the work equipment and the target surface,
the work machine including an actuator state sensor that detects a state of the actuator, wherein
the controller
calculates a velocity of the work equipment based on the position of the work implement and an operation amount of the operation device,
determines whether or not there is a possibility of entry of the work equipment into a lower side of the target surface due to operation based on the velocity of the work equipment, the distance between the work equipment and the target surface, and the state of the actuator detected by the actuator state sensor, and
changes contents of informing by the informing device when determining that there is the possibility of entry of the work equipment into the lower side of the target surface, thereby making a warning by the informing device.

2. The work machine according to claim 1, wherein
the controller calculates an angle formed by the work equipment and the target surface and changes the contents of informing by the informing device further according to the angle formed by the work equipment and the target surface.

3. The work machine according to claim 2, wherein
the actuator state sensor detects a load acting on the actuator, and
the controller
employs an excess of the operation amount of the operation device as the contents of informing by the informing device when the velocity of the work equipment has such a direction as to come closer to the target surface and the distance between the work equipment and the target surface is equal to or shorter than a predetermined threshold and the load acting on the actuator detected by the actuator state sensor is equal to or lower than a predetermined threshold and the angle formed by the work equipment and the target surface is equal to or larger than a predetermined threshold, and
does not employ an excess of the operation amount of the operation device as the contents of informing by the informing device when the velocity of the work equipment has such a direction as to come closer to the target surface and the distance between the work equipment and the target surface is equal to or shorter than the predetermined threshold and the load acting on the actuator detected by the actuator state sensor is equal to or lower than the predetermined threshold and the angle formed by the work equipment and the target surface is smaller than the predetermined threshold.

4. The work machine according to claim 1, wherein the actuator state sensor detects a load acting on the actuator, and the controller employs an excess of the operation amount of the operation device as the contents of informing by the informing device when the velocity of the work equipment has such a direction as to come closer to the target surface and the distance between the work equipment and the target surface is equal to or shorter than a predetermined threshold and the load acting on the actuator detected by the actuator state sensor is equal to or lower than a predetermined threshold, and does not employ an excess of the operation amount of the operation device as the contents of informing by the informing device when the velocity of the work equipment has such a direction as to come closer to the target surface and the distance between the work equipment and the target surface is equal to or shorter than the predetermined threshold and the load acting on the actuator detected by the actuator state sensor is higher than the predetermined threshold.

5. The work machine according to claim 1, wherein an arm is included in the work implement, and the controller changes the contents of informing by the informing device further according to whether or not operation of the arm through the operation device exists.

6. The work machine according to claim 1, wherein a boom is included in the work implement, and when operation of the boom through the operation device exists, the controller computes an intersection of a movement locus of the work equipment and the target surface, carries out predictive calculation of a velocity vector of the work equipment at the intersection and changes the contents of informing by the informing device according to a component perpendicular to the target surface in the velocity vector of the work equipment at the intersection.

7. The work machine according to claim 1, wherein the informing device is a display device, and the controller changes a position at which the work equipment is displayed on the display device, according to the velocity of the work equipment, the distance between the work equipment and the target surface, and the state of the actuator detected by the actuator state sensor.

8. The work machine according to claim 7, wherein the actuator state sensor detects a load acting on the actuator, and the controller changes the position at which the work equipment is displayed on the display device from a reference position according to the velocity of the work equipment when the distance between the work equipment and the target surface is equal to or shorter than a predetermined threshold and operation is being input to the operation device and the load acting on the actuator detected by the actuator state sensor is equal to or lower than a predetermined threshold, and sets the position at which the work equipment is displayed on the display device to the reference position when the distance between the work equipment and the target surface is equal to or shorter than the predetermined threshold and operation is being input to the operation device and the load acting on the actuator detected by the actuator state sensor is higher than the predetermined threshold.

9. The work machine according to claim 1, wherein the informing device is a display device that displays either one of a first screen in which the work equipment and the target surface are displayed and a second screen in which at least whole of the work machine and the target surface are displayed, the second screen including a wider range than the first screen, and the controller decides which of the first screen and the second screen is to be displayed on the display device according to the velocity of the work equipment, the distance between the work equipment and the target surface, and the state of the actuator detected by the actuator state sensor.

10. The work machine according to claim 9, wherein the actuator state sensor detects a load acting on the actuator, and the controller decides to display the first screen on the display device when the distance between the work equipment and the target surface is equal to or shorter than a predetermined threshold and the velocity of the work equipment has such a direction as to come closer to the target surface and the load acting on the actuator detected by the actuator state sensor is equal to or lower than a predetermined threshold, and decides to display the second screen on the display device when the distance between the work equipment and the target surface is equal to or shorter than the predetermined threshold and the velocity of the work equipment has such a direction as to come closer to the target surface and the load acting on the actuator detected by the actuator state sensor is higher than the predetermined threshold.

* * * * *